US007969378B2

(12) United States Patent
Bongfeldt et al.

(10) Patent No.: US 7,969,378 B2
(45) Date of Patent: Jun. 28, 2011

(54) RADIO ANTENNA ASSEMBLY

(75) Inventors: David Charles Bongfeldt, Stittsville (CA); Trevor Noel Yensen, Ottawa (CA)

(73) Assignee: Allen-Vanguard Technologies Inc. (CA)

( * ) Notice: Subject to any disclaimer, the term of this patent is extended or adjusted under 35 U.S.C. 154(b) by 364 days.

(21) Appl. No.: 12/202,078

(22) Filed: Aug. 29, 2008

(65) Prior Publication Data

US 2009/0140939 A1 Jun. 4, 2009

Related U.S. Application Data

(60) Provisional application No. 60/969,305, filed on Aug. 31, 2007.

(51) Int. Cl.
*H01Q 9/16* (2006.01)
*H01Q 1/32* (2006.01)

(52) U.S. Cl. ..... 343/801; 343/827; 343/713

(58) Field of Classification Search ..... 343/790, 343/801, 827, 828, 891, 713
See application file for complete search history.

(56) References Cited

U.S. PATENT DOCUMENTS

| | | | | |
|---|---|---|---|---|
| 4,186,403 | A * | 1/1980 | Dorne | 343/801 |
| 5,364,049 | A | 11/1994 | Long | |
| 5,600,335 | A * | 2/1997 | Abramo | 343/749 |
| 6,057,804 | A * | 5/2000 | Kaegebein | 343/792 |
| 6,225,954 | B1 | 5/2001 | Edvardsson et al. | |
| 6,366,237 | B1 | 4/2002 | Charles | |
| 7,183,992 | B2 * | 2/2007 | Hung | 343/790 |
| 7,202,826 | B2 | 4/2007 | Grant et al. | |

FOREIGN PATENT DOCUMENTS

| | | |
|---|---|---|
| CA | 2462721 | 4/2004 |
| CA | 2560382 | 3/2007 |
| JP | 2001119217 A2 | 4/2001 |
| WO | 9613075 | 5/1996 |
| WO | 2004091106 | 10/2004 |

OTHER PUBLICATIONS

International Search Report dated Dec. 16, 2008, for PCT/CA2008/001539.
International Search Report dated Dec. 23, 2008, for PCT/CA2008/001540.

* cited by examiner

*Primary Examiner* — Hoang V Nguyen
(74) *Attorney, Agent, or Firm* — Barnes & Thornburg LLP

(57) ABSTRACT

An antenna assembly is provided for mounting on a predetermined support structure positioned on a surface, the support structure having a peripheral edge at an elevated position above the surface. The antenna assembly includes an antenna and a support for supporting the antenna at an elevated position above the surface when mounted on the support structure. The support is adapted to support the antenna at a sufficient height above the surface to provide a direct path for electromagnetic radiation from at least a portion of the antenna to a position on the surface external of the peripheral edge of less than or equal to about 4.5 meters from substantially any point on the peripheral edge, or to a position on the surface at a point positioned 3 meters from the front of the support structure and 3 meters from a side of the support structure.

17 Claims, 14 Drawing Sheets

RADIO ANTENNA ASSEMBLY

CROSS-REFERENCE TO RELATED APPLICATIONS

This U.S. non-provisional patent application claims priority from U.S. Provisional Patent Application No. 60/969,305 filed on 31 Aug., 2007, the entire contents of which is incorporated herein by reference.

FIELD OF THE INVENTION

The present invention relates to radio antennas and antenna assemblies and in particular, but not limited to, antennas and antenna assemblies for vehicles and other mobile units.

BACKGROUND OF THE INVENTION

Vehicle mounted radio antennas are generally known for receiving radio broadcast signals and for two-way communication in mobile telephone applications. Vehicle mounted antenna are also known for voice communications in military applications.

In static applications, a known antenna assembly comprises an antenna array comprising several vertically stacked dipole antennas each of which operates over the same frequency band. In transmission mode, each antenna is fed the same carrier frequency signal with the signal fed to the upper and lower antennas being phase shifted relative to middle antenna to increase the concentration of electromagnetic energy in the horizontal direction.

SUMMARY OF THE INVENTION

The inventors have discovered that when transmitting at certain frequencies from a vehicle mounted antenna, the signal strength is significantly lower than expected in certain regions in close proximity to the vehicle, and that such regions of lower than expected signal strength occur particularly for higher frequencies and where the vehicle significantly shadows and scatters the signal. Thus, as the vehicle moves towards an object, such as a receiver, the signal strength fades significantly when the vehicle is in close proximity with the receiver resulting in the receiver receiving less than the desired signal strength. In some applications, the signal emitted by the antenna comprises a jamming signal and the receiver may be a receiver for a remote controlled explosive device, for example. Accordingly, fading of the jamming signal when the vehicle is in close proximity to the receiver may render the jamming signal ineffective, and enable the explosive device to be remotely detonated.

In view of the above, it would be desirable to provide an improved antenna assembly which is capable of producing adequate signal strength and coverage in close proximity to the vehicle or other support on which it is mounted.

According to one aspect of the present invention, there is provided an antenna assembly for mounting on a predetermined support structure positioned on a surface, said support structure having a peripheral edge at an elevated position above the surface, the antenna assembly comprising an antenna and a support for supporting the antenna at an elevated position above said surface, when mounted on said support structure, wherein the support is adapted to support the antenna at a sufficient height above said surface to provide a direct path for electromagnetic radiation from at least a portion of the antenna to a position on the surface external of the peripheral edge, of less than or equal to about 4.5 meters from substantially any point on the peripheral edge, or to a position on the surface at a point positioned a first predetermined distance from the front of the support structure and a predetermined distance from a side of the support structure, or to a position on the surface a predetermined distance from the center of the support structure.

Thus, where the position on the surface is less than or equal to about 4.5 meters from substantially any point on the peripheral edge, the antenna has a direct line of sight to substantially all positions along the peripheral edge spaced a distance of 4.5 meters from the peripheral edge, or less. In other words, the inner edge of the direct line of sight footprint extends around the support structure so that the inner edge is no more than about 4.5 meters away from the peripheral footprint at the surface at any position on the peripheral edge.

The inventors have determined that at certain frequencies, the vehicle's metallic shell causes significant shadowing, reflecting and scattering of electromagnetic radiation emitted by an antenna mounted on the exterior of the vehicle. Mounting the antenna at a sufficient height to provide a direct line of sight from at least a portion of the antenna to a region within close proximity to the vehicle substantially improves uniformity of the signal strength around the vehicle and reduces both the number and depth of spatial nulls. The inventors have further determined that, although interference of the direct path signal by out-of-phase, indirect path signals, for example, scattered from the vehicle surface, causes some attenuation of the direct path signal, the direct path signal is significantly stronger than the scattered multi-path signals and therefore the amount of attenuation of the direct path signal is relatively small.

For the purpose of determining the position from the peripheral edge of the support structure, the surface may be a planar surface.

Certain features of support structure are predetermined. For example, the support structure has predetermined dimensions, including length, width and possibly height above the surface, the shape of the peripheral edge and the height of different portions of the peripheral edge above the surface. Different portions of the upper surface of the support structure may be at different levels above the surface. The position on the support structure (and its height above the surface) for mounting the antenna assembly may also be predetermined.

In some embodiments, the support is arranged so that when mounted on the support structure, the antenna is positioned at a sufficient height above the surface to provide a direct path for electromagnetic radiation from at least a portion of the antenna to a position on the surface external of the peripheral edge of less than or equal to 3.6 meters from substantially any point on the peripheral edge.

In some embodiments, the antenna is configured for transmitting electromagnetic radiation over a substantially full azimuthal range of angles, i.e. over an azimuthal range of substantially 360°.

In some embodiments, the magnitude of the electromagnetic energy radiated from the antenna varies with angle of elevation of the radiated energy.

In some embodiments, the magnitude of the electromagnetic energy has a range of values between a maximum value at a first angle of elevation and a predetermined lower value at a second angle of elevation, and the longest direct path from the antenna to the position on the surface has an angle between the first and second angles, inclusive. In some embodiments, the predetermined lower value may be about 3 dB below the maximum value. Thus, in this embodiment, an upper limit is placed on the height of the antenna above the surface, so that at the predetermined position at the surface, the RF signal has a strength at or above a predetermined minimum value.

In some embodiments, the longest direct path from the antenna to the position on the surface forms an angle with the vertical greater than or equal to a predetermined minimum angle. The predetermined minimum angle may be an angle where the magnitude of electromagnetic radiation is between a maximum value and a predetermined value of less than the maximum value. The predetermined value may for example be about 3 dB below the maximum value.

In some embodiments, the antenna assembly further comprises biasing means for biasing the spread of electromagnetic radiation emitted from the antenna in a downward direction. Thus, in this embodiment, for a vertical antenna, more electromagnetic radiation emitted from the antenna is directed below the horizontal than above the horizontal. Advantageously, this arrangement may increase the amount of electromagnetic radiation received at the position on the surface.

In some embodiments, the biasing means comprises a second antenna.

In some embodiments, the antenna is configured to bias the spread of electromagnetic radiation downwardly. This may be achieved by configuring the antenna asymmetrically. For example, in the case of a dipole antenna, or where the antenna comprises two radiating elements, the lower element may be longer than the upper element, and/or an additional element may be provided which capacitively couples with the lower element more than with the upper element.

In some embodiments, the first antenna has upper and lower ends, the second antenna has upper and lower ends, and wherein the upper end of the second antenna is below the upper end of the first antenna.

In some embodiments, the antenna assembly further comprises an RF signal source coupled to the first and second antennas and for providing an RF signal having a first frequency to the first antenna and an RF signal having a second frequency to the second antenna. The first frequency may be different from the second frequency, and in some embodiments, the second frequency is below the first frequency.

In some embodiments, the second signal has a different phase to the first signal.

In some embodiments, an RF signal is applied to each of the first and second antennas such that at least one common frequency or frequency band is applied to both antennas. The common frequency or frequency band applied to the first antenna may have a different phase to the common frequency or frequency band applied to the second antenna to bias the direction of emitted radiation downwardly.

In some embodiments, the RF signal applied to the first and/or second antenna includes one or more different frequency(ies) to the frequency(ies) applied to the other of the first and second antenna.

In some embodiments, the antenna assembly further comprises control means for controlling the elevational direction of electromagnetic radiation emitted from the antenna.

In some embodiments, the antenna assembly comprises means for concentrating the elevational spread of electromagnetic radiation emitted from the first antenna. In some embodiments, the concentrating means comprises a second antenna.

In some embodiments, the area of the support within the peripheral edge is substantially opaque to electromagnetic radiation emitted from the antenna. In some embodiments, the area of the support within the peripheral edge has no direct path from the antenna to the surface.

In some embodiments, the support comprises a mobile support. The support may, for example, comprise a vehicle. In some embodiments, the vehicle comprises a military vehicle.

In some embodiments, the support has opposed ends and a center, midway between the opposed ends, and the antenna is offset from the center towards one of the ends. The opposed ends may comprise a front end and a rear end of the support, and the antenna may be offset towards the rear end.

In some embodiments, the support has opposed sides and a center between the opposed sides and the antenna is offset from the center towards one of the opposed sides.

In some embodiments, the antenna comprises a ground plane independent antenna, for example, one of a bicone antenna and a dipole antenna.

In some embodiments, the antenna is limited to operate within a predetermined frequency band, wherein the frequency band is within a range having a lower frequency of about 200 MHz. The inventors have found that for the particular type of vehicle tested whose length is about 5 m, and for frequencies of 200 MHz and above, a direct line of sight from the antenna to the position on the surface substantially increases signal strength at the position and reduces the depth of spatial nulls.

In some embodiments, the minimum frequency to be radiated by the antenna having a direct line of sight to the critical position on the surface is related to the length of the vehicle. In one embodiment, the minimum frequency is determined as that for which the ratio $1/\lambda$ is in the range 2.5 to 4, for example 3 to 3.5, where 1 is the length of the vehicle (or support) and $\lambda$ is the wavelength of the RF signal.

In some embodiments, the antenna assembly further comprises a second antenna supported by the support.

In some embodiments, the support is adapted to support the second antenna at a sufficient height above the surface to provide a substantially direct path for transmission of electromagnetic radiation from at least a portion of the second antenna to a position at the surface of less than or equal to 3 meters (for example equal to or less than 2.5 meters) from substantially any point on the peripheral edge.

In some embodiments, the first antenna has opposed upper and lower ends, the second antenna has opposed upper and lower ends, and the upper end of the second antenna is positioned below the upper end of the first antenna.

In some embodiments, the upper end of the second antenna is adjacent the lower end of the first antenna. In some embodiments, the second antenna is positioned to capacitively couple with the first antenna. In some embodiments, a portion of the length of the second antenna overlaps a portion of the length of the first antenna.

In some embodiments, the first and second antennas each have a longitudinal axis and the axes are substantially coaxially aligned.

In some embodiments, the second antenna at least partially supports the first antenna.

In some embodiments, the first antenna is limited to operate over a first frequency band between first upper and first lower frequencies and the second antenna is limited to operate over a second frequency band between a second upper frequency and a second lower frequency, wherein the second upper frequency is below the first upper frequency.

In some embodiments, the first lower frequency is substantially adjacent the second upper frequency. Thus, the frequency bands may or may not partially overlap.

In some embodiments, the antenna assembly further comprises biasing means for biasing the elevational spread of electromagnetic radiation emitted from the second antenna in a downward direction.

In some embodiments, the antenna assembly further comprises means for concentrating the spread of electromagnetic radiation emitted from the second antenna.

In some embodiments, the antenna assembly further comprises a third antenna supported by the support at an elevated position above the surface.

In some embodiments, the third antenna has upper and lower ends, and the upper end of the third antenna is positioned below the upper end of the second antenna.

In some embodiments, the upper end of the third antenna is positioned substantially adjacent the lower end of the second antenna. In some embodiments, the third antenna is positioned to capacitively couple with the second antenna. In some embodiments, a portion of the length of the third antenna overlaps a portion of the length of the second antenna.

In some embodiments, the third antenna has an axis extending between its first and second ends, and the axis is substantially coaxially aligned with the axis of at least one of the first and second antennas.

In some embodiments, the third antenna at least partially supports at least one of the first and second antennas.

In some embodiments, the third antenna is limited to operate efficiently over a predetermined frequency having upper and lower frequencies, and wherein the upper frequency of the third antenna is below the upper frequency of the second antenna.

In some embodiments, the upper frequency of the third antenna is substantially adjacent the lower frequency of the second antenna.

In some embodiments, the third antenna comprises a ground plane independent antenna, e.g. a bicone antenna or dipole antenna.

The second antenna may comprise a ground plane independent antenna, e.g. a bicone antenna or dipole antenna.

In some embodiments, the support includes mounting means for mounting the antenna assembly on a vehicle.

According to another aspect of the present invention, there is provided an antenna assembly comprising an antenna, a support for supporting the antenna at an elevated position above a surface, the support having a peripheral edge positioned above the surface, wherein the support structure is adapted to support the antenna at a sufficient height above said surface to provide a direct path for electromagnetic radiation from at least a portion of the antenna to a position on the surface external of the peripheral edge, of less than or equal to about 4.5 meters from substantially any point on the peripheral edge, or to a position on the surface at a point positioned a first predetermined distance from the front of the support and/or a predetermined distance from a side of the support, or to a position on the surface a predetermined distance from the center of the support.

According to another aspect of the present invention, there is provided an antenna assembly comprising a first antenna limited to operate over a first frequency band between a first upper and a first lower frequency, the antenna having opposed upper and lower ends, a second antenna limited to operate over a second frequency band between a second upper frequency and a second lower frequency, the second antenna having opposed upper and lower ends, wherein the second upper frequency is different from the first upper frequency, and support means for supporting the first antenna at a position above the second antenna such that the upper end of the second antenna is below the upper end of the first antenna.

In some embodiments, the second upper frequency is below the first upper frequency.

In some embodiments, the antenna assembly further comprises biasing means for biasing the elevational spread of electromagnetic radiation emitted from at least one of the first and second antennas downwardly.

In some embodiments, the antenna is configured to bias the spread of electromagnetic radiation downwardly. This may be achieved by configuring the antenna asymmetrically. For example, in the case of a dipole antenna, or where the antenna comprises two radiating elements, the lower element may be longer than the upper element, and/or an additional element may be provided which capacitively couples with the lower element more than with the upper element.

In some embodiments, the biasing means comprises a controller for controlling at least one of the relative frequency and relative phase of the electromagnetic radiation emitted from at least one of the first and second antennas.

In some embodiments, the upper end of the second antenna is substantially adjacent the lower end of the first antenna.

In some embodiments, each of the first and second antennas has an axis extending between the respective opposed ends thereof, and the axis of the first and second antennas are substantially coaxially aligned.

In some embodiments, the second antenna at least partially supports the first antenna.

In some embodiments, one or more of the first and second antennas comprises a ground plane independent antenna, e.g. a bicone antenna or a dipole antenna.

In some embodiments, the antenna assembly further comprises a signal source coupled to at least one of the first and second antennas for providing a jamming signal thereto.

In some embodiments, one or more of the first and second antennas is capable of transmitting electromagnetic radiation over substantially the full range of azimuthal angles.

According to another aspect of the present invention, there is provided an antenna assembly comprising an antenna for emitting radio frequency electromagnetic radiation therefrom and biasing means for biasing the elevational spread of electromagnetic radiation emitted from the antenna downwardly.

In some embodiments, the antenna is configured to bias the spread of electromagnetic radiation downwardly. This may be achieved by configuring the antenna asymmetrically. For example, in the case of a dipole antenna, or where the antenna comprises two radiating elements, the lower element may be longer than the upper element, and/or an additional element may be provided which capacitively couples with the lower element more than with the upper element.

In some embodiments, the antenna is capable of transmitting electromagnetic radiation over substantially the full range of azimuthal angles.

In some embodiments, the biasing means comprises a second antenna.

In some embodiments, the second antenna has upper and lower ends, in which the upper end is positioned below the upper end of the first antenna.

In some embodiments, the biasing means comprises a controller for controlling at least one of the relative frequency and relative phase of electromagnetic radiation emitted from at least one of the first and second antennas.

In some embodiments, the antenna assembly further comprises concentrating means for concentrating the spread of electromagnetic radiation emitted from the antenna.

In some embodiments, the antenna assembly comprises a signal source coupled to at least one of the first and second antennas for providing a jamming signal thereto.

In some embodiments, one or more of the first and second antennas comprises a ground plane independent antenna, e.g. a bicone antenna or a dipole antenna.

According to another aspect of the present invention, there is provided an antenna assembly comprising one or more antennas including a first antenna, mounting means for mounting the antenna to a vehicle, concentrating means for concentrating the spread of electromagnetic radiation emitted from the antenna and a signal source coupled to the antenna for providing a jamming signal thereto.

In some embodiments, one or more of the antennas is configured for transmitting electromagnetic radiation over substantially the full range of azimuthal angles.

In some embodiments, the concentrating means comprises a second antenna.

In some embodiments, the concentrating means may further comprise a controller for controlling at least one of the relative frequency and relative phase of electromagnetic radiation emitted from at least one of the first and second antennas.

According to another aspect of the present invention, there is provided an antenna assembly comprising an antenna, a support for supporting the antenna at an elevated position above a surface, the support having a peripheral edge positioned above the surface, wherein the support is adapted to support the antenna at a sufficient height above said surface to provide a direct path for electromagnetic radiation from at least a portion of the antenna to any position between opposed ends of the support that is spaced at least one of (1) about 2.5 to 3 meters or (2) less than about 2.5 to 3 meters from a side of said support.

Thus, in this arrangement, the antenna has a direct line of sight at least to substantially all positions along a side of the support structure between the ends which are spaced 3 meters from the side. In other words, the inside edge of the direct line of sight footprint is no more than 3 meters from one or both sides of the support structure between the ends thereof.

In some embodiments, the antenna is positioned centrally between the two sides or offset to one side so that the direct path must traverse at least half or more than half of the width of the support structure to the critical position on the surface.

According to another aspect of the present invention, there is provided an antenna assembly comprising an antenna, a support for supporting the antenna at an elevated position above a surface, the support having a peripheral edge positioned above the surface, wherein the support is adapted to support the antenna at a sufficient height above the surface to provide a direct path for electromagnetic radiation from at least a portion of the antenna to a position on the surface external of the peripheral edge spaced about 2.5 to 3 meters from one or both ends of said support or less than about 2.5 to 3 meters from one or both ends of said support and between a side of said support and about 2.5 to 3 meters from said side.

Thus, in this arrangement, the antenna has a direct line of sight to a position spaced both 3 meters from an end and 3 meters from a side of the support structure. In other words, the direct line of sight footprint includes this position.

In some embodiments, the antenna has a direct line of sight from the antenna to all positions spaced both 3 meters from one or both ends and between one or both sides and 3 meters from a respective side.

In some embodiments, the antenna has a direct line of sight to all positions spaced both 3 meters from one or both sides and between one or both ends and 3 meters from a respective end.

In some embodiments, the antenna is positioned on the support structure either centrally between the sides and/or ends and/or offset towards a side and/or end. The direct path or line of sight may traverse at least half or more than half of the width and/or the length of the support structure to reach the or each position on the surface.

According to another aspect of the present invention, there is provided an antenna assembly for mounting on a support structure positioned on the surface and having a peripheral edge, the antenna assembly comprising an antenna and a support for supporting the antenna on the support structure wherein the support is configured to support the antenna at a sufficient height above said surface when mounted on said support structure to provide a direct path for electromagnetic radiation from at least a portion of the antenna to a position on the surface external of the peripheral edge, wherein said position comprises any one or more of the positions disclosed or claimed herein.

According to another aspect of the present invention, there is provided a method of designing an antenna support comprising selecting a support structure on which to mount the antenna, the support structure having a peripheral edge, selecting a position on the support structure on which to mount the antenna, determining a height for the antenna, when mounted at said selected position, to provide a direct path from at least a portion of the antenna to a position on a surface below the selected support structure and spaced externally of a peripheral edge of the support structure by a distance of any one or more of (1) less than or equal to about 3.6 to 4.5 meters from substantially any point on the peripheral edge, (2) a position at any point between opposed ends of said support which is spaced about 2.5 to 3 meters or less from a side of said support structure, (3) a position of about 2.5 to 3 meters or less than 2.5 to 3 meters from a side of said support structure and about 2.5 to 3 meters or less from one or both ends of said support structure and (4) a position of about 2.5 to 3 meters from an end of said support structure and between a side of said support structure and about 2.5 to 3 meters from said side, and designing a support for mounting on the support structure and for supporting the antenna at the determined height.

According to another aspect of the present invention, there is provided an antenna for radiating electromagnetic radiation having opposed ends and a structure which biases the direction of radiation emitted outwardly from the antenna towards one of said ends.

BRIEF DESCRIPTION OF THE DRAWINGS

Examples of embodiments of the present invention will now be described with reference to the drawings, in which.

DESCRIPTION OF EMBODIMENTS

Figure 1:
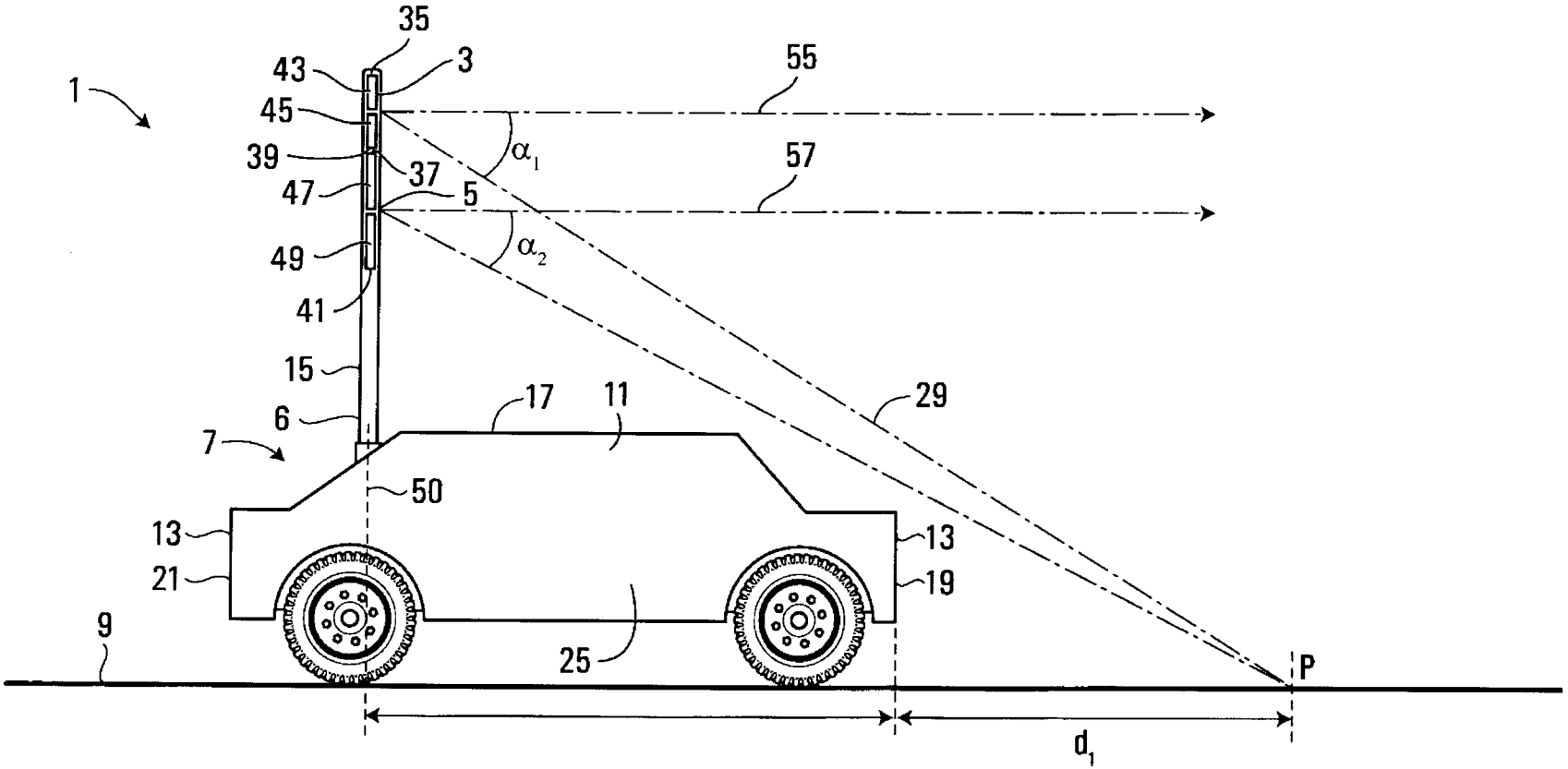
FIG. 1 shows a side view of an antenna assembly according to an embodiment of the present invention.
Figure 2:
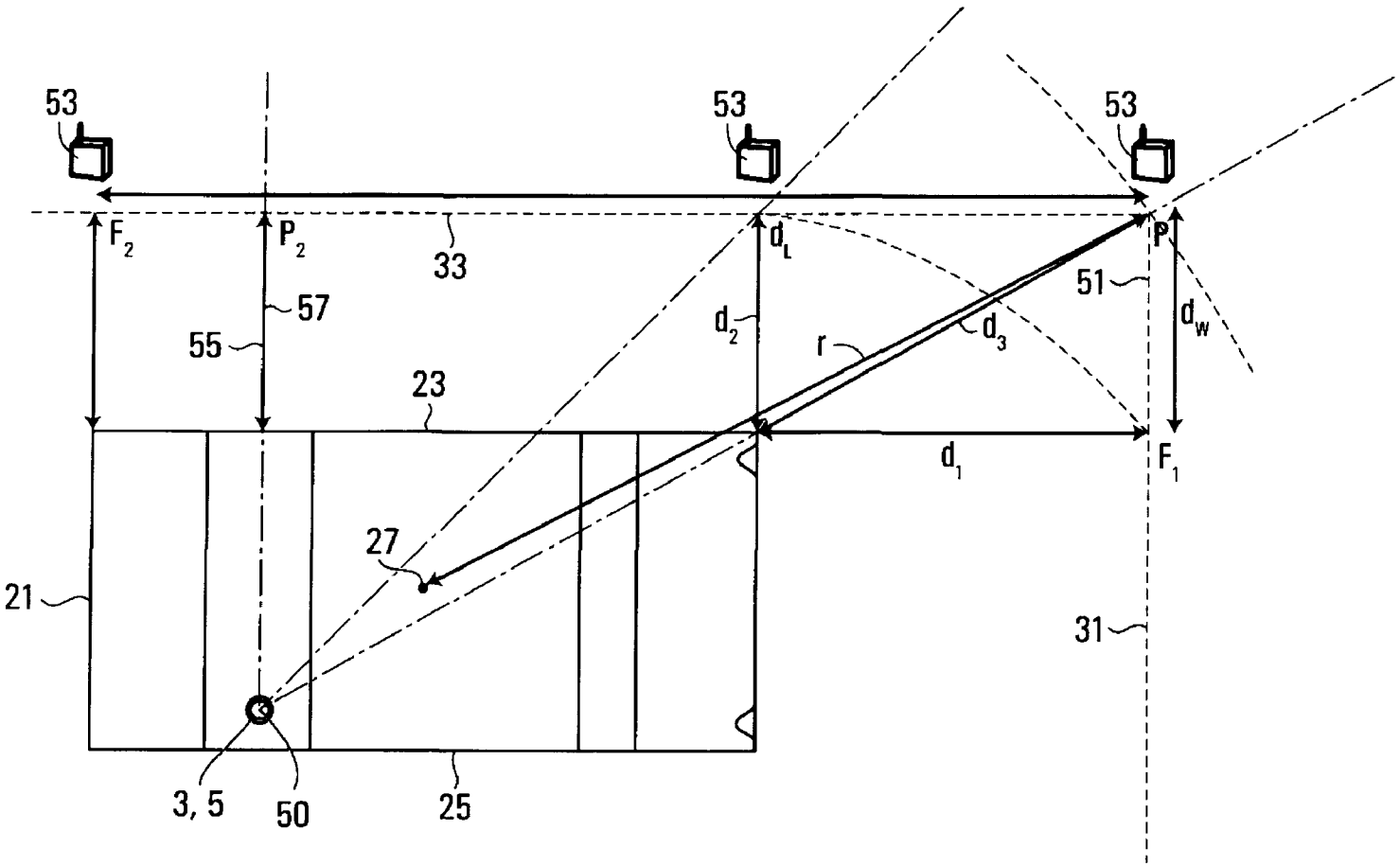
FIG. 2 shows a plan view of the antenna assembly shown in FIG. 1.
Figure 3:
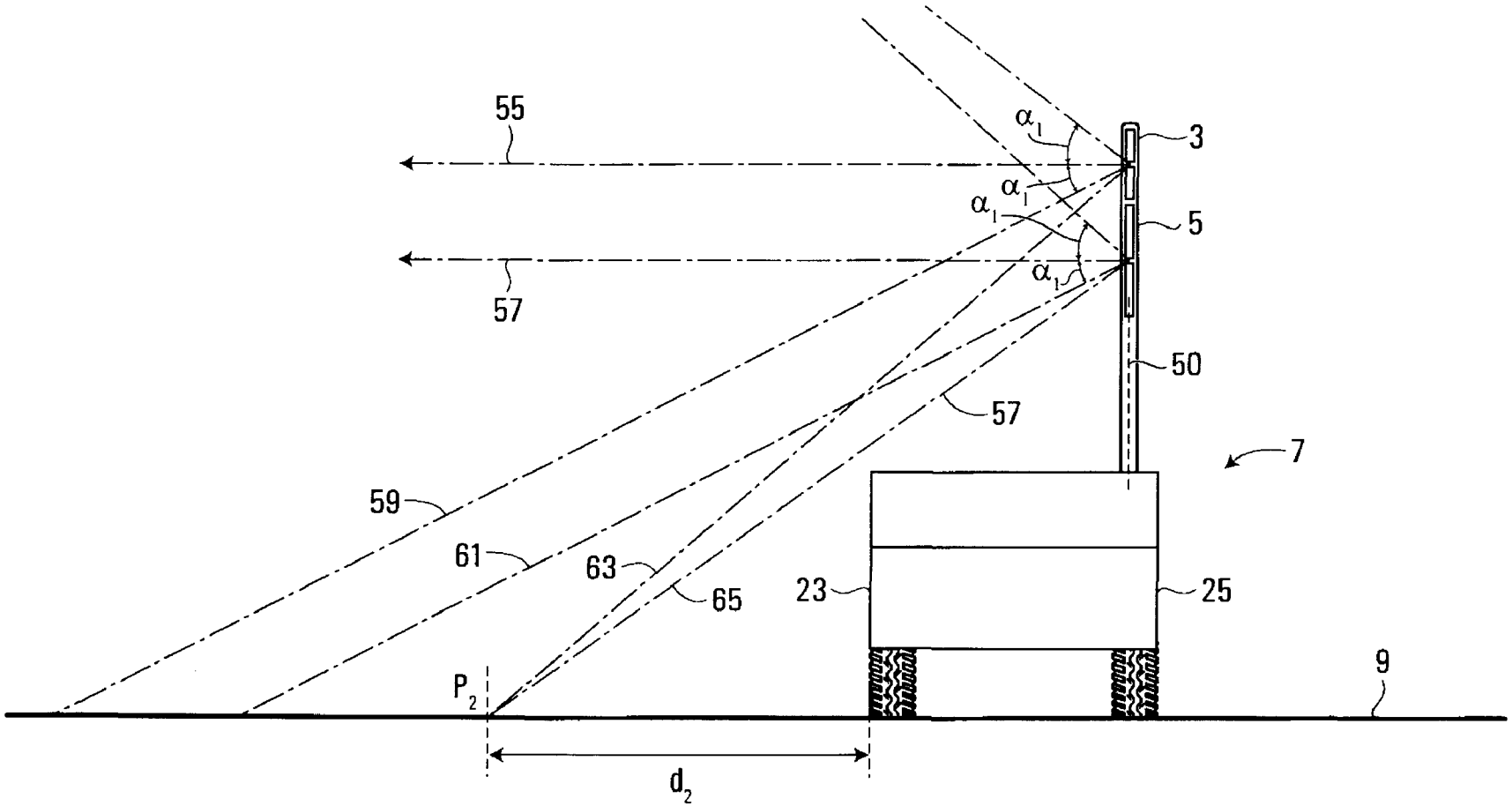
FIG. 3 shows a rear view of the antenna assembly shown in FIGS. 1 and 2.

Referring to FIGS. 1 to 3, an antenna assembly 1 comprises a first antenna 3, a second antenna 5 and a support 6 for supporting the first and second antennas at an elevated position above a surface 9, when mounted on a predetermined support structure 7. In this embodiment, the support structure 7 comprises a mobile structure 11 having a peripheral edge 13. The antenna support comprises an upright member 15 upstanding from the mobile structure 11 for supporting the first and second antennas at a position above the top 17 of the mobile structure. Thus, together, the antenna support 6 and the support structure 7 support the antennas at an elevated position above the surface.

The mobile structure has opposed front and rear ends 19, 21 and opposed left and right sides 23, 25. In this embodiment, the first and second antennas are located at a position which is offset from the center 27 of the mobile support structure 11 towards the rear end 21 and towards the right side 25. In other embodiments, the first and second antennas may be located at any other position on the support structure, for example at the center position 27 or at any other location.

The support 6 is configured to support the first antenna 3 at a sufficient height above the surface 9 to provide a direct path 29 for electromagnetic radiation from at least a portion of the antenna (for example, the mid or main radiating region, or region between elements of a ground plane independent antenna) to a position, P, on the surface 9 spaced from the front end of the support structure (e.g. vehicle) by a distance of less than or equal to $d_1$ and spaced from a side 23 of the support structure by a distance of less than or equal to $d_2$. In some embodiments, the distance $d_1$ has any value in the range of 2.5 to 3 meters. In some embodiments, the distance $d_2$ has any value in the range 2.5 to 3 meters.

In some embodiments, the first antenna 3 is positioned at a sufficient height above the surface 9 to provide a direct path for electromagnetic radiation from at least a portion of the antenna 3 to a position on the surface, external of the peripheral edge 13 of the support structure of less than or equal to a distance $d_3$ from substantially any point on the peripheral edge 13. As can be appreciated from FIG. 2, the distance $d_3$ is the furthest distance from the peripheral edge 13 of the support structure to any point spaced a distance $d_1$ from either end of the mobile support structure and spaced a distance $d_2$ from either side of the support structure as shown by the boundary lines 31 and 33. Distance $d_3$ may be determined as $\sqrt{d_1^2+d_2^2}$, and may have a value in the range of 3.5 to 4.3 meters, for example. The position P is also the position on the boundary at the surface, where the boundary around the support structure is spaced at a distance $d_1$ from either end of the support structure and a distance $d_2$ from either side of the support structure, for which the direct path from the first antenna 3 to the any point on the boundary is longest.

In this embodiment, the second antenna 5 is also positioned at a sufficient height above the surface 9 to provide a direct path for electromagnetic radiation from at least a portion (e.g. the mid, or main radiating region, or region between elements of a ground plane independent antenna) of the second antenna to the position P, as defined above, and shown in FIG. 2.

Referring to FIGS. 1 and 3, the first and second antennas each have an upper end 35, 37 and a lower end 39, 41. The upper end 37 of the second antenna 5 is positioned below the lower end 39 of the first antenna, and is positioned relatively close or adjacent thereto. In this embodiment, the first antenna comprises a dipole antenna having a pair of dipole elements 43, 45. The second antenna 5 is also a dipole antenna having a pair of dipole elements 47, 49. In this embodiment, the dipole elements of the first and second antennas are substantially coaxially aligned.

In other embodiments, the first and second antennas may comprise any other suitable form of antenna, non-limiting examples of which include any other ground plane independent antenna (e.g. a bicone antenna) or a monopole antenna.

Providing a direct path for electromagnetic radiation emitted from the first antenna 3 to a position on the surface spaced a distance $d_1$ in front of the mobile support structure and spaced a distance $d_2$ from one side of the support structure has been found to significantly improve the signal strength at that position, particularly for relatively high frequencies, in comparison to other arrangements in which only indirect paths for electromagnetic radiation exist between the antenna and that position. Thus, this arrangement significantly mitigates the effects of scattering and shadowing by the support structure. Similar benefits are obtained by providing a direct path between at least a portion of the second antenna 5 and the position.

In some embodiments, a direct line of sight from either one or both of the first and second antennas 3, 5 may be provided over a range of lateral distances $d_w$ positioned at a distance $d_1$ from the front peripheral edge of the support structure from point P (at $d_2$) towards the side (e.g. side 23) of the support structure. The range, for example, may be the range 51 between point P and point $F_1$ which corresponds to a lateral position at the side 23 of the support structure. In other embodiments, the range may be greater or less than the range 51. This arrangement helps to ensure that a continuous region of relatively high signal strength exists across a region in front of and proximate to the support structure, and which extends from a position P to at least the side 23 of the support structure, for example.

In some embodiments, a direct path from one or both of the first and second antennas may be provided over a range of longitudinal distances $d_L$ from point P towards the rear of the support structure spaced a distance $d_2$ from a side 23 of the support structure. The range may extend from point P to at least to a position $F_2$ which corresponds to the rear end 21 of the support structure or beyond the rear end 21.

This arrangement helps to ensure that a continuous region of relatively high signal strength exists along the side of the support structure and which extends at least from the front of the support structure to the rear of the support structure, and which is positioned relatively close to the side of the support structure. This enables a receiver device 53 (which in FIG. 2 is shown in three different positions relative to the mobile structure) to remain continuously in communication with the first and second antennas as the mobile structure approaches and moves past the device. If one or both of the first and second antennas emits a jamming signal, this enables the receiver device 53 to be continuously jammed as the vehicle passes the device. If the device is a remote controlled explosive device, this enables detonation of the device to be reliably prevented.

In some embodiments, the inner edge of the direct line of sight footprint may extend substantially fully around the support structure, so that the inner edge is no more than about 4.5 meters away from the peripheral edge at any position on/along/around the peripheral edge.

Conventional dipole antennas have an antenna pattern in which the signal intensity is a maximum along a line perpendicular to the dipole axis and decreases as the elevation angle increases from the line towards the dipole axis. Thus, referring to FIG. 3, if the first and second antennas are dipole antennas, radiation lines 55 and 57 perpendicular to the dipole axes 50 represent the line of maximum radiation. At an elevation angle $\alpha_1$ from the maximum intensity lines 55, 57, of typically 40°, the intensity level drops by 3 dB, as indicated by intensity level lines 59, 61 in FIG. 3. In some embodiments, the 3 dB intensity level lines may intercept the surface 9 at a position having a greater distance from the side of the support structure than $d_2$ as indicated by position $P_2$. In this case, the intensity level lines 63 and 65 between position $P_2$ and the respective first and second antennas 3, 5 have a greater angle of elevation than the 3 dB intensity lines and therefore their intensity is lower per unit distance from the antennas than the 3 dB intensity lines. However, as the path length of these lower intensity lines from the antennas to position $P_2$ is shorter than the path length from the 3 dB intensity lines from the antennas to the surface, the shorter path length compensates at least partially for the steeper elevation angle, and the signal intensity at position $P_2$ remains relatively high.

Figure 4:
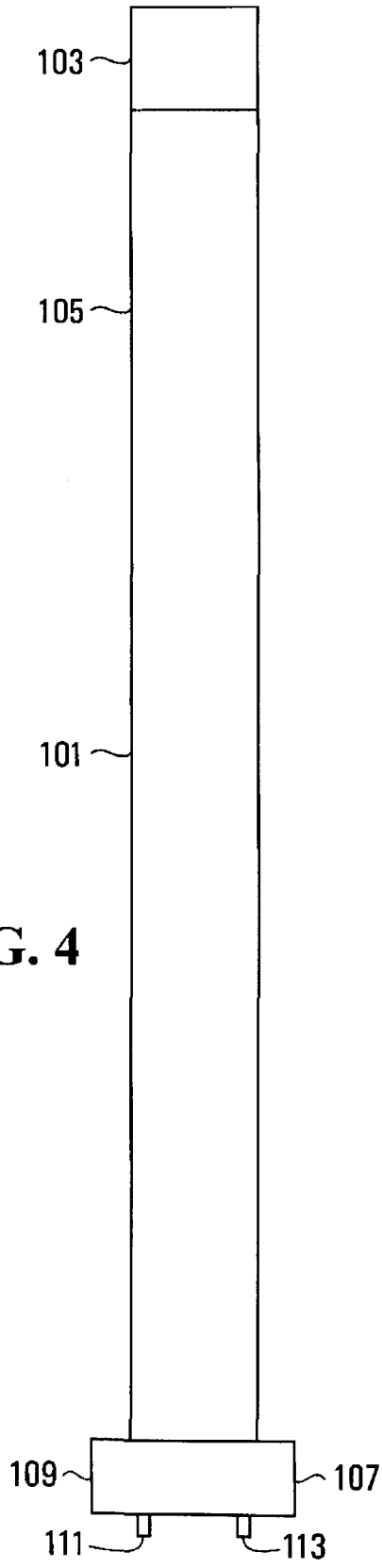
FIG. 4 shows a side view of an antenna assembly according to an embodiment of the present invention.

FIG. 4 shows a schematic diagram of an antenna assembly according to an embodiment of the present invention. In this example, the antenna assembly 101 comprises two antennas 103, 105 in which the first antenna 103 is positioned above the second antenna 105. A mounting structure 107 is provided at the base 109 of the antenna assembly 101 for mounting the antenna assembly to a support structure, e.g. vehicle (not shown). The antenna assembly includes first and second RF ports 111, 113 for passing RF signals to the first and second antennas 103, 105, respectively from an external source.

The antenna assembly includes a support for supporting the first antenna 103 at an elevated position above the base 109. The support may for example be provided at least partially by the second antenna 105, and/or by a housing at least partially enclosing the second antenna, and/or by some other structure upstanding from the base 109.

In this embodiment, each of the first and second antennas 103, 105 are designed to operate efficiently over a limited frequency band, in which the upper operating frequency of the first antenna 103 is above the upper operating frequency of the second antenna 105. The first antenna 103 may be designed to operate at frequencies which are readily scattered by a support structure on which the antenna assembly is or is to be mounted. Locating the first antenna at an upper position of the antenna assembly brings positions on a surface below the support structure having a direct line of sight to the first antenna closer to the support structure, so that RF signals from the antenna are relatively strong at such positions. The height of the first antenna 103 above a surface is the height above the base 109 of the antenna assembly at which the first antenna is supported plus the height of any support structure from the surface to the base 109. The antenna assembly may be configured so that the height of the first antenna 103 above the base 109 provides the desired height of the first antenna 103 above the surface when mounted on a particular support structure, e.g. a mobile structure such as a vehicle, for example, or a static support structure.

In some embodiments, the operating frequency band of the second antenna 105 may be such that the support structure on which the antenna assembly is to be mounted does not significantly scatter or shadow electromagnetic radiation emitted therefrom. At such frequencies, it has been found that the support structure does not significantly interfere with the signal strength at locations proximate the peripheral edge of the support structure. Embodiments of the invention exploit this fact by locating such an antenna at a lower position of the antenna assembly, for example below the upper antenna, thereby making use of the space between the upper antenna and the base of the antenna assembly and not lengthening the antenna assembly unnecessarily. In some embodiments, the second antenna 105 may be located so that there is no or no substantial direct line of sight between the antenna and a position on the surface spaced from the support structure where the RF signal strength emitted from the second antenna should be relatively high.

The upper operating frequency limit of the second antenna 105 may either be above, adjacent or below the lower operating frequency limit of the first antenna 103. The first antenna 103 may be any suitable antenna for emitting relatively high frequencies such as a dipole, bicone or other ground plane independent antenna, and the second antenna 105 may be any suitable antenna for operating at relatively low frequencies, such as a dipole or monopole antenna.

Figure 5:
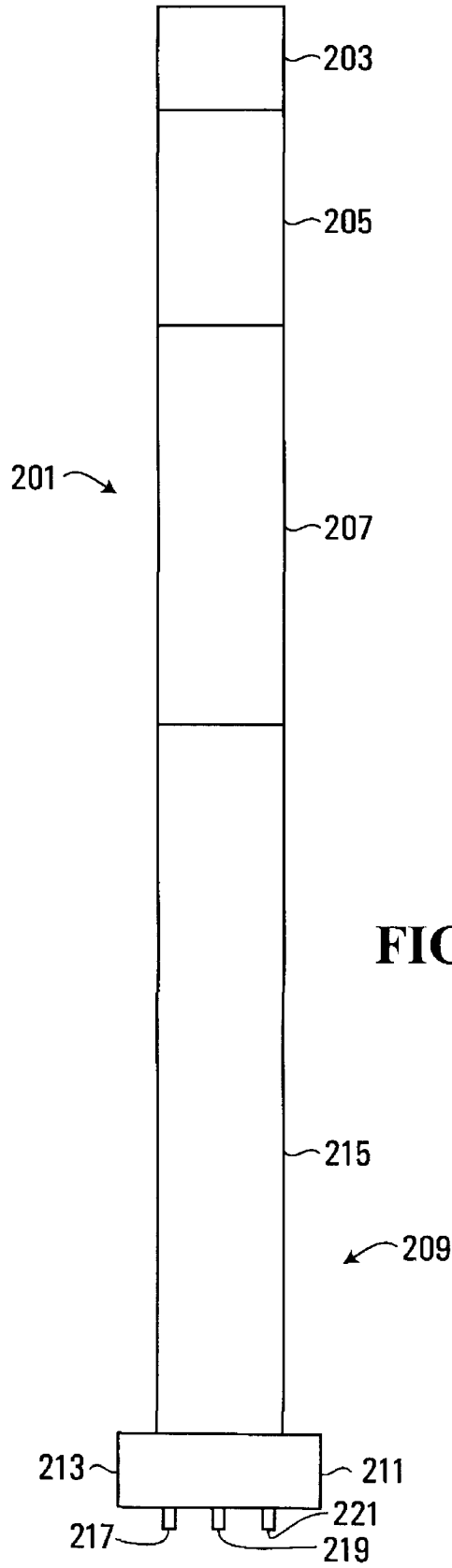
FIG. 5 shows a side view of an antenna assembly according to an embodiment of the present invention.

FIG. 5 shows another example of an antenna assembly according to an embodiment of the present invention. The antenna assembly 201 comprises three antennas 203, 205, 207 and an antenna support 209 which includes a mounting structure 211 at the base 213 of the antenna assembly and a support section 215 upstanding from the mounting structure 211. Three RF ports 217, 219, 221 are provided for passing RF signals to the respective first, second and third antennas 203, 205, 207.

In this embodiment, the second antenna 205 is positioned above the third antenna 207 and the first antenna 203 is positioned above the second antenna 205. Each of the antennas operates efficiently over a limited frequency band, and in some embodiments, the upper operating frequency limit of the second antenna 205 is below the upper operating frequency limit of the first antenna, and/or the upper operating frequency limit of the third antenna 207 is below the upper operating frequency limit of the second antenna 205. In this arrangement, each of the antennas is positioned at an elevational level of the antenna assembly which increases with the operational frequency band of the antenna. Thus, the first antenna 203 which operates at the highest frequency band is the uppermost antenna, the second antenna 205 which operates at the second highest frequency is positioned below the first antenna 203 and the third antenna 207 which operates at the lowest frequency band is positioned below the second antenna 205.

The lower antenna 207 is supported by the support section 215. The second antenna 205 may be supported at least partially by the third antenna 207, and/or by a housing at least partially enclosing the third antenna 207 or by some other support structure. The first antenna 203 may be supported at least partially by the second antenna 205, by a housing of the antenna assembly at least partially enclosing the second antenna or by some other support structure.

The operating frequency band of the first antenna 203 may be such that electromagnetic radiation within the frequency band is significantly scattered by a support structure on which the antenna assembly 201 is or is to be mounted. The antenna assembly is configured so that the height of the first antenna 203, when mounted on the support structure, is at a sufficient height above the surface on which the support structure is located to provide a direct line of sight between the first antenna and a position on the surface spaced a predetermined distance from the peripheral edge of the support structure, where sufficient signal strength from the first antenna is critical.

In some embodiments, the second and/or third antenna 205, 207 may operate at frequencies which are also significantly scattered by the support structure to which the antenna assembly is or is to be mounted, and the antenna assembly is configured so that the second and/or third antenna is positioned at a sufficient height above the surface when mounted to the support structure to provide a direct line of sight between the respective antenna and a critical position on the surface spaced from the peripheral edge of the support structure. In a specific embodiment, the second antenna 205 is positioned at a sufficient height to provide a direct line of sight to the critical position on the surface, but the third antenna 207 operates at frequencies at which the electromagnetic radiation is not significantly scattered by the support structure, and is positioned at a height where there is no or substantially no direct line of sight from the third antenna to the critical position on the surface.

In some embodiments, the first and second antennas 203, 205 may be designed to operate at relatively high frequencies, and may for example comprise a bicone or dipole antenna. The third antenna 207 may be designed to operate at intermediate frequencies and may comprise any of a bicone, dipole or monopole antenna or any other form of antenna.

In some embodiments, the antenna assemblies shown in FIGS. 4 and 5 and described above may form a set of antennas intended to be used together and mounted on the same support structure. The operational frequency band of one or more antennas may be different from the operational frequency band of one or more other antennas of the set. In some embodiments, the operational frequency band of two or more antennas may be substantially the same. In a specific embodiment, the operational frequency band of each antenna is different from any other antenna of the set. For example, the operational frequency band of the first antenna 103 of the antenna assembly 101 of FIG. 4 may be the highest, the frequency band of the second antenna 105 of the first antenna assembly 101 may be the lowest and each of the frequency bands of the first, second and third antennas 203, 205, 207 of the second antenna assembly 201 may be between the highest and lowest operating frequency bands of the first and second antennas 103, 105 of the first antenna assembly. One or more of the operational frequency bands may be adjacent another or at least partially overlap so that the antenna set is collectively capable of efficiently emitting RF signals over a substantially continuous, broad frequency range. In other embodiments, the operating frequency bands of the antennas may be selected to provide a gap between one or more frequency bands. Such a configuration may be implemented where it is not necessary or desirable for the antennas to emit over a specific range of frequencies, for example.

In some embodiments, one or more of the antennas of the antenna assemblies 101, 201 of the FIGS. 4 and 5 are arranged to emit radiation over the full azimuthal range, i.e. over 360°.

In some embodiments, the antennas of an antenna assembly may be positioned so that the upper end of one antenna is at an elevational level which is either at, below or above the lower end of an upper antenna. Thus, in some embodiments, the elevational position of two or more antennas may or may not overlap. In the former case, the lateral dimension of overlapping antennas may be such that each antenna does not interfere with the propagation of electromagnetic radiation emitted from another antenna at the wavelength(s) concerned. In some embodiments, one or more antennas may be arranged to capacitively couple with another, e.g. adjacent, antenna to control the direction of RF radiation, as more fully described below.

Figure 6:
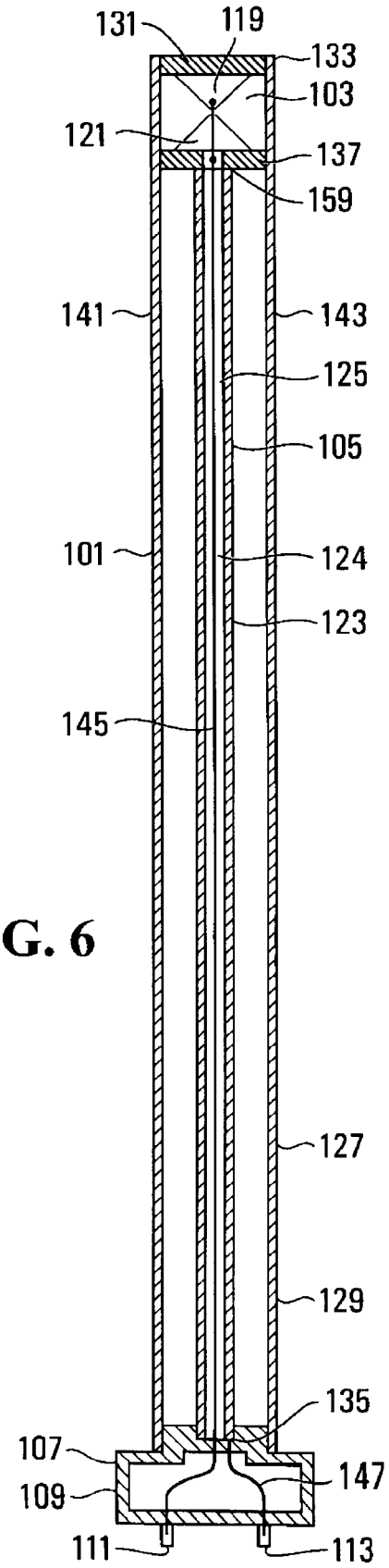
FIG. 6 shows a cross-sectional view through an antenna assembly according to an embodiment of the present invention.

A specific example of the antenna assembly of FIG. 4 is shown in more detail and in cross-section in FIG. 6. In this embodiment, the first antenna 103 is a bicone antenna and the second antenna 105 is a monopole antenna. The bicone antenna 103 comprises opposed upper and lower cones 119, 121. The monopole antenna 105 comprises a single hollow tubular element 123 defining an internal conduit 125. The antenna assembly includes a housing 127 which at least partially encloses the first and second antennas 103, 105, and in this embodiment comprises a hollow tube having a cylindrical wall 129 extending upwardly from the base 109 of the assembly, and an optional top or cover 131 adjacent the upper end 133 of the housing. The cylindrical wall 129 of the housing comprises a suitable dielectric material which is substantially transparent to the electromagnetic radiation in the frequency band(s) of the antennas. In this embodiment, the lower end 135 of the antenna element 123 is supported by and extends upwardly from the base 109. A spacer element 137 is positioned between the first and second antennas 103, 105, and in this embodiment is positioned adjacent the upper end 139 of the second antenna and the bottom of the lower cone 121. The spacer 137 may be adapted to resist or prevent relative lateral movement between the antenna element 123 and the housing 127. For example, as shown in FIG. 6, the spacer extends between opposed wall portions 141, 143 of the housing 127 to prevent lateral movement between the spacer and the housing, and an upper end portion of the antenna element 123 may engage with the spacer 137 to substantially prevent lateral movement between the spacer and the antenna element. Alternatively, one or more other spacer elements may be provided, for example at other positions between the upper and lower ends of the antenna element 123 to resist or prevent lateral movement between the antenna element and the housing.

In this embodiment, the spacer element 137 supports the first antenna 103. The first antenna 103 and the spacer element 137 may be supported by the second antenna only (for example if the spacer element is free to slide up and down relative to the antenna housing), by only the antenna housing 127 (for example if the spacer element 137 is not free to move up and down relative to the housing), or by a combination of both the antenna element 123 and the housing.

The first RF port 111 is connected to one of (e.g. the upper) conical elements 119, 121, of the bicone antenna via a suitable RF lead 145, which may conveniently pass through the inner conduit 124 of the second antenna element 123, as shown in FIG. 6. In other embodiments, the RF lead may pass externally of the second antenna element. The second RF port 113 is electrically connected to the second antenna element 123 via a suitable RF lead 147.

Figure 7:
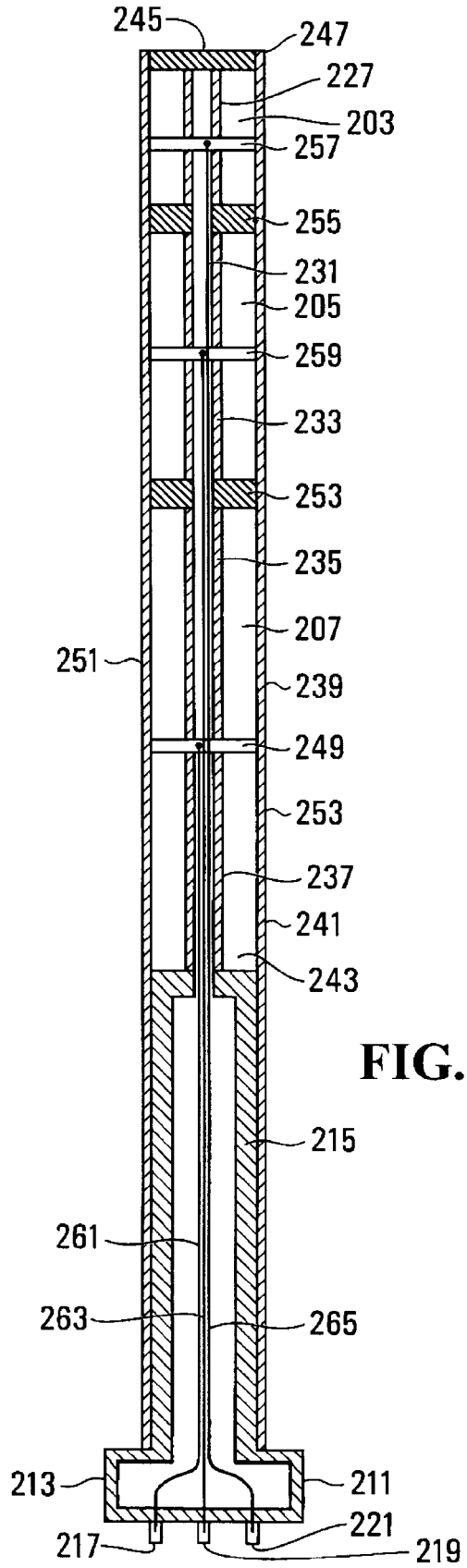
FIG. 7 shows a cross-sectional view through an antenna assembly according to an embodiment of the present invention.

An example of the embodiment of the antenna assembly illustrated in FIG. 5 is shown in more detail in FIG. 7. In this embodiment, each of the first, second and third antennas 203, 205, 207 comprises a dipole antenna in which the first antenna 203 comprises upper and lower dipole elements 227, 229, the second antenna 205 comprises upper and lower dipole elements 231, 233 and the third antenna 207 comprises upper and lower dipole elements 235, 237. In this embodiment, each of the dipole elements has the form of a hollow tube having cylindrical walls defining an inner, longitudinal conduit therethrough. Each dipole antenna may be a quarter- or half-wave length antenna.

The antenna assembly further comprises a housing 239 which at least partially encloses the first, second and third antennas 203, 205, 207 and which, in this embodiment, comprises an outwardly extending cylindrical wall 241 defining an internal space 243 for accommodating the antennas and an optional top or cover 245 positioned adjacent the upper end 247 of the housing. The housing assembly includes a support section 215 extending upwardly from the base 213 which supports the lower antenna 207. A spacer element 249 separates the first and second dipole elements of the lower antenna 207 and optionally extends between opposed wall sections 251, 253 of the housing. A spacer element 253 separates the second and third antennas and spaces the antennas apart in the vertical direction. Similarly, a spacer 255 is positioned between the first and second antennas 203, 205 to separate the antennas from one another and which also spaces the antennas apart in the vertical direction. An additional spacer element 257, 259 is provided between respective dipole elements of the first and second antennas to separate the dipole elements of the same antenna, and which may optionally extend between opposed wall sections 251, 253 of the housing. Each of the spacer elements 253, 255 between the antennas may have any of the features described above in connection with the spacer element 137 of the antenna assembly 101 shown in FIG. 6.

The first RF port 217 is connected to the first antenna 203 via a suitable RF lead 261, the second RF port 219 is connected to the second antenna 205 via a suitable RF lead 263 and the third RF port 221 is connected to the third antenna 203 via a suitable RF lead 265. One or more of the RF leads may conveniently pass through the internal conduit defined through the tubular dipole elements of the antennas, for example as shown in FIG. 7, and may pass through the interior of the support section 215. However, in other embodiments, the RF leads may be positioned externally of the support section 215 and/or one or more antenna elements 203, 205, 207.

Figure 8:
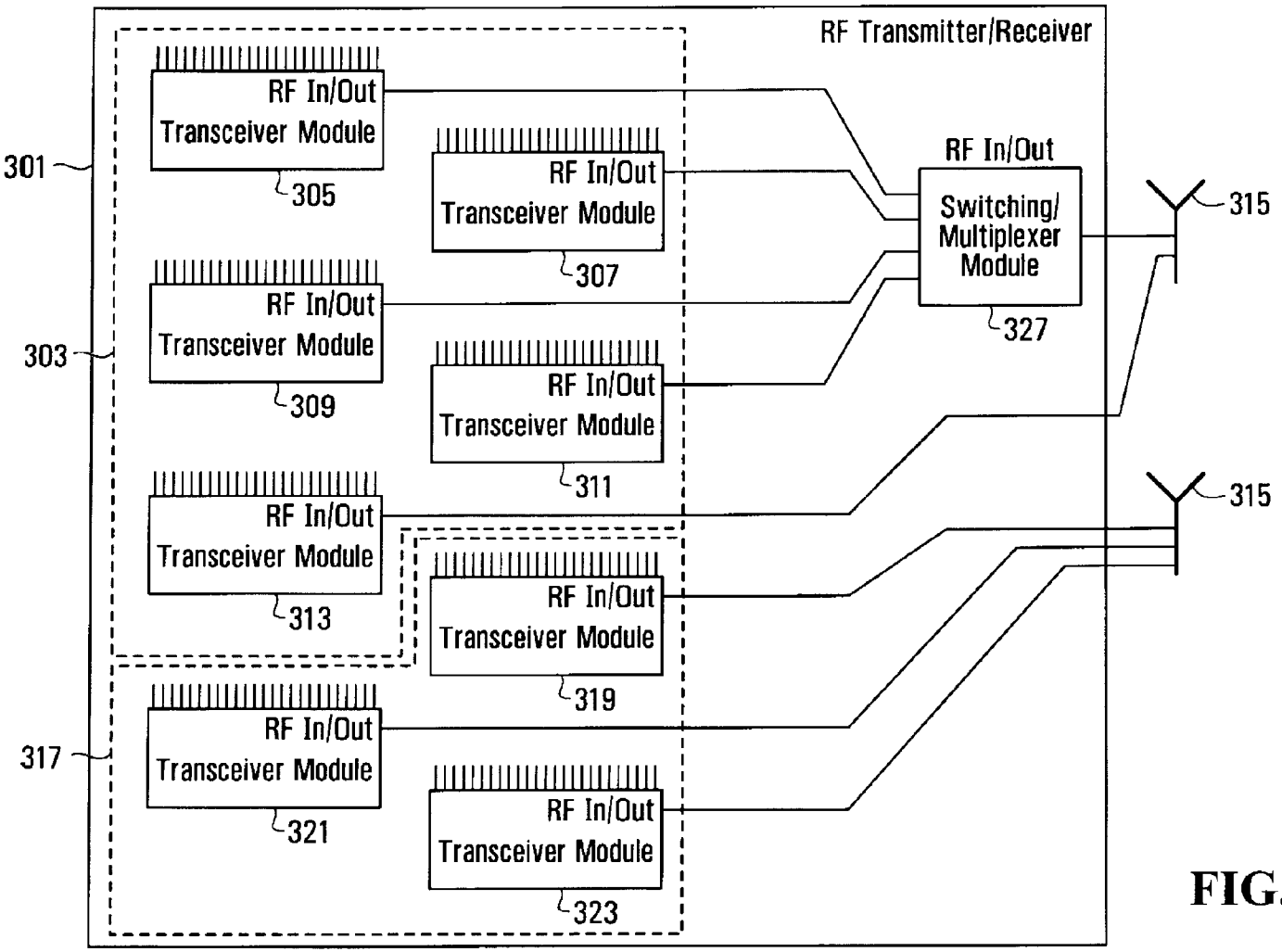
FIG. 8 shows a schematic diagram of a configuration of radio transmitter modules and antenna assemblies according to an embodiment of the present invention.

FIG. 8 shows a schematic block diagram of an embodiment of an RF transmitter/receiver for use with embodiments of the antenna assembly. The RF transmitter/receiver 301 comprises a first group 303 of transceiver modules 305, 307, 309, 311, 313 for providing RF signals to a first antenna assembly 315 and a second group 317 of transceiver modules 319, 321, 323 for providing RF signals to a second antenna assembly 325. In this example, the first antenna assembly 315 has first and second antennas, one of which is a high frequency band antenna and the other is a low frequency band antenna. The antenna assembly 315 may, for example, be similar to that described above in conjunction with FIGS. 4 and 6. In this example, the second antenna assembly 325 comprises three antennas each of which may have a low or mid-frequency operating band. The second antenna assembly 325 may be similar to that described above with reference to FIGS. 5 and 7, for example. The transceiver modules may be specifically configured to operate within a predetermined limited frequency band. Two or more transceiver modules may be connectable to the same antenna, for example so that the antenna either receives RF signals from only one RF transceiver module at any one time or receives RF signals simultaneously from two or more transceiver modules. In the specific example of FIG. 8, four transceiver modules 305, 307, 309, 311 are connectable to the first antenna of the antenna assembly 315 via a switching module (or multiplexer) 327. The switching/multiplexer module may be configured to connect only one transceiver module to the antenna at any one time and/or be capable of connecting two or more transceiver modules to the antenna simultaneously. In this embodiment, one transceiver module 313 of the first group is connected to the second antenna of the first antenna assembly 315. In this embodiment, each transceiver module 319, 321, 323 of the second group 317 is connected to the respective first, second and third antennas of the second antenna assembly 325.

As mentioned above, each transceiver module may be adapted to operate over a specific frequency band. Two or more modules connectable to the same antenna may be configured to operate over the same frequency band. One or more frequency bands may be divided into two or more sub bands and two or more modules connectable to the same antenna may be configured to operate within the same frequency band but different sub-bands thereof. In a specific, non-limiting example, each of transceiver modules 307, 309 and 311 are configured to operate within a mid-frequency band and each module is adapted to operate within a different sub-frequency band of the mid-band. Transceiver module 305 of the first group 303 may be configured to operate within a high frequency band, for example, and transceiver module 313 may be adapted to operate over a low frequency band, and possibly over a sub band within a low frequency band. Each of the transceiver modules 319, 321, 323 of the second group 317 may be configured to operate within a low frequency band and each may operate within a different sub-band of the low frequency band. Each low frequency sub-band of the second group of transceiver modules may be different from the low frequency sub-band of the transceiver module 313 of the first group. In other embodiments, any other configuration of receiver modules is possible. Although the switching/multiplexer module in the embodiment of FIG. 8 is adapted to switch/couple different transceiver modules to the same antenna, in other embodiments, a switching/multiplexer module may be provided to switch/couple the same transceiver module to different antennas.

In some embodiments, two or more different operating frequency bands of two or more modules may be substantially adjacent one another so that the transceiver modules together cover a continuous spectrum of frequencies between the lower frequency band and the upper frequency of the upper frequency band.

Although in some embodiments, one or more antennas of the antenna assembly may comprise a broadband antenna, each antenna may beneficially comprise a relatively narrow band antenna tuned to operate over a specific limited frequency band to provide increased antenna gain and coverage performance.

In other embodiments, the RF system connected to an antenna assembly may comprise one or more transmitter modules adapted only for transmitting RF signals, or one or more receiver modules configured only for receiving RF signals from the antenna assembly or one or more transceiver modules capable of both transmitting and receiving RF signals to and from an antenna assembly. In some embodiments, two or more modules may be switchably coupled to a single antenna of an antenna assembly or a single module may be switchably coupled between different antennas of the same antenna assembly or between different antennas of different antenna assemblies.

According to another aspect of the present invention, an antenna assembly is provided having at least one antenna in which the direction of radiation emitted from the antenna is biased in a downward direction so that there is a higher concentration of electromagnetic radiation below the horizon than above the horizon. In some embodiments, means may be provided for concentrating the electromagnetic radiation in a narrower elevational band. Examples of embodiments of this aspect of the invention are described below with reference to FIGS. 9 to 12.

Figure 9:
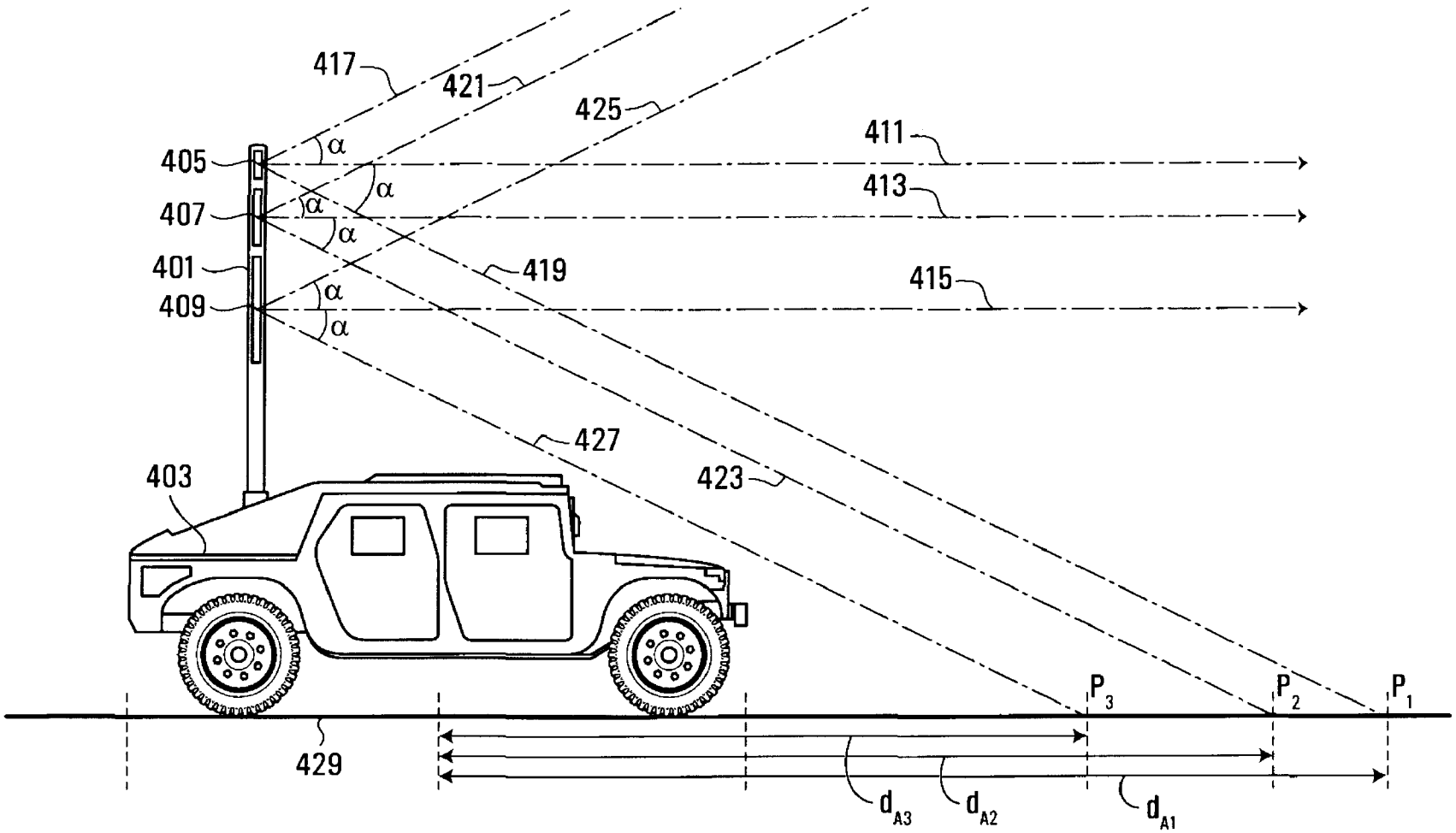
FIG. 9 shows a side view of an antenna assembly according to an embodiment of the present invention.

FIG. 9 shows an example of an antenna assembly 401 mounted on a mobile support structure 403. The antenna assembly comprises three antennas 405, 407, 409 arranged in a stacked formation. In operation, each antenna radiates electromagnetic radiation with the direction of maximum radiation intensity being perpendicular to the antenna axis, as shown by the horizontal intensity lines 411, 413, 415. As illustrated, each antenna radiates radiation both above and below the respective horizontal line 411, 413, 415 of maximum intensity, and in this embodiment, the distribution of electromagnetic radiation with angle of elevation is symmetrical above and below the respective line of maximum radiation. The intensity of radiation decreases as the angle of elevation increases towards the antenna longitudinal axis and radiation lines 417, 419 illustrate the direction of electromagnetic radiation emitted from the first antenna 405 at which the intensity is reduced by a predetermined value, e.g. 3 dB from the maximum value. For a dipole antenna, the angle of elevation $\alpha$ at which the intensity of radiation has decreased by 3 dB is typically about 40°. Similarly, lines 421 and 423 illustrate the direction of radiation of the second antenna 407 for which the intensity of radiation is decreased by a predetermined value, e.g. 3 dB, and lines 425 and 427 show the direction of radiation from the third antenna 409 for which the intensity of radiation has decreased by a predetermined value, e.g. 3 dB. The downwardly directed, reduced intensity lines 419, 423, 427 from the first, second and third antennas, respectively, intercept the surface 429, above which the support structure is positioned, at points P1, P2, P3 spaced from the front of the support structure by distances $d_{A1}$, $d_{A2}$ and $d_{A3}$, respectively.

Figure 10:
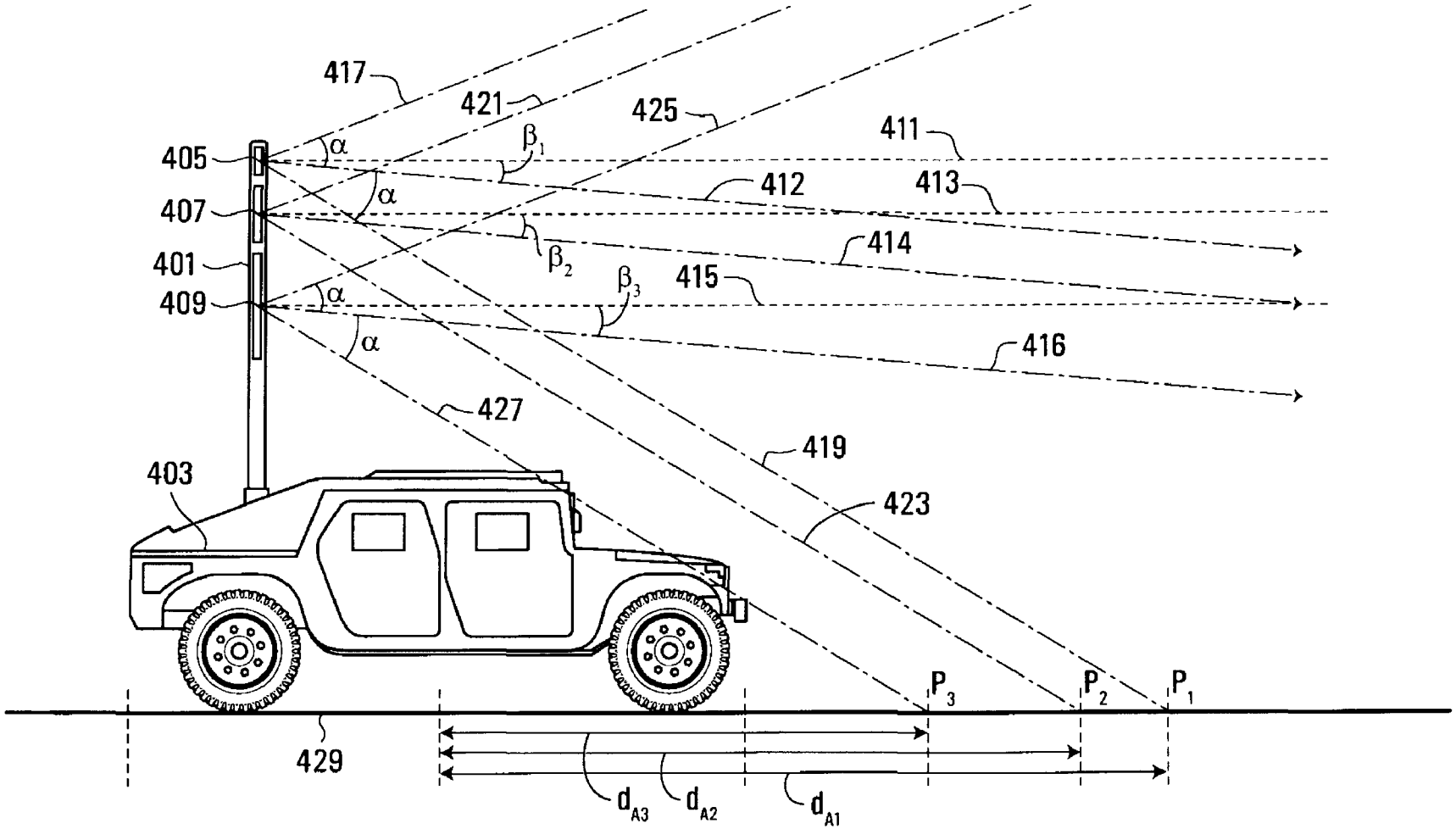
FIG. 10 shows a side view of an antenna assembly according to an embodiment of the present invention.

FIG. 10 shows a modification of the arrangement shown in FIG. 9 in which the electromagnetic radiation emitted from each antenna is biased in a downward direction. Thus, as illustrated in FIG. 10, the direction 412 of maximum radiation intensity from the first antenna 405 is at a negative elevational angle $\beta_1$ relative to the horizontal direction 411, the direction 414 of maximum radiation intensity from the second antenna 407 is at a negative elevational angle $\beta_2$ relative to the horizontal line 413 and the direction 416 of maximum radiation intensity from the third antenna 409 is at a negative elevational angle $\beta_3$ relative to the horizontal line 415. In this particular example, angles $\beta_1$, $\beta_2$ and $\beta_3$ each have the same value, although in other embodiments, the elevational angle of maximum intensity of one antenna may be different from that of another antenna.

In this embodiment, each of the predetermined reduced intensity lines 417, 421, 425 above the respective line of maximum intensity and reduced intensity lines 419, 423, 427 below the respective line of maximum intensity are at the same elevational angle, $\alpha$, relative to the respective line of maximum intensity. Thus, with respect to the arrangement of FIG. 9, the angle subtending the reduced intensity lines of an antenna is the same and the only change is the direction of the radiation distribution from each antenna, which in FIG. 10 is, on average, in a downward direction.

As can be seen in FIG. 10, the positions P1, P2, P3 at which the downwardly directed reduced intensity lines 419, 423, 427 intercept the surface 429 are closer to the support structure 403 than in FIG. 9. The reduced intensity lines also have a direct line of sight to the surface from each antenna. Thus, by downwardly directing radiation from one or more antennas, the radiation intensity at the surface near the support structure can be considerably increased.

Each antenna may radiate over a full range of azimuthal angles or at least a range which includes one or both sides of the support structure and the distribution of radiation emitted from the antenna is directed downwardly over either the full range of azimuthal angles or a partial range which includes one or both sides of the vehicle. It can be appreciated that, with this arrangement, the intensity of radiation emitted from the antenna assembly near one or both sides of the vehicle can be considerably increased.

Figure 11:
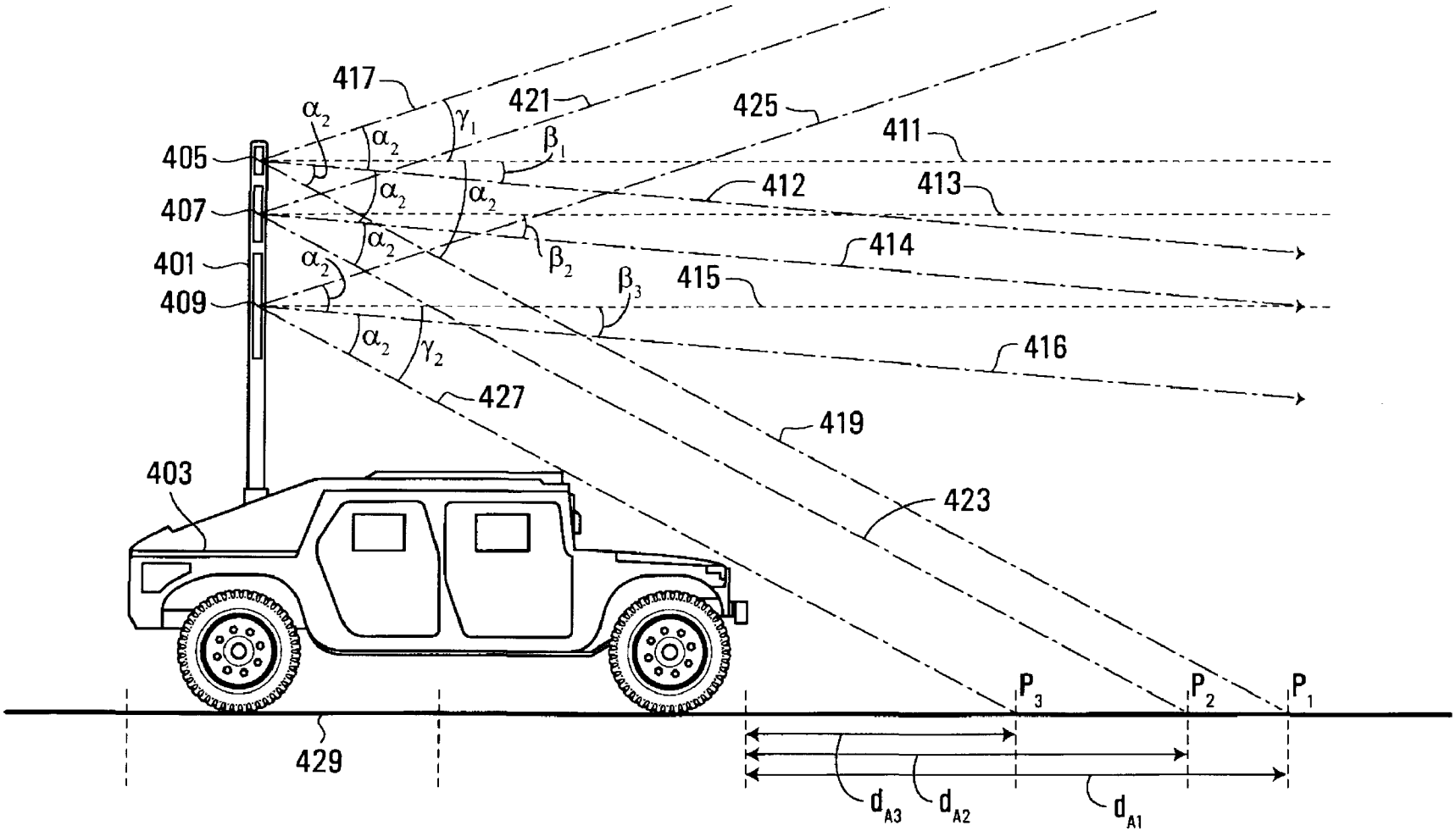
FIG. 11 shows a side view of an antenna assembly according to an embodiment of the present invention.

FIG. 11 shows another arrangement which is a modification of that shown in FIG. 10. In FIG. 11, the radiation distribution from each of the first, second and third antennas 405, 407, 409 is angled downwardly at an angle $\beta_1$, $\beta_2$, $\beta_3$ with respective to the horizontal, the difference being that the elevational spread of radiation is more concentrated than that of FIG. 10, so that the lines of reduced intensity 417, 421, 425, 419, 423, 427 are at a reduced angle $\alpha_2$ relative to the respective line 412, 414, 416 of maximum intensity in comparison to the angle $\alpha$ of the arrangement of FIG. 10.

The combination of both tilting the angular distribution of electromagnetic radiation downwardly and concentrating the angular distribution within a narrower range of angles increases the intensity of radiation at locations at or near the surface on which the antenna assembly is placed. Depending on the tilt angle, this arrangement may also increase the intensity of radiation at positions closer to the antenna assembly support structure. For example, referring to FIG. 11, the tilt angle $\beta_1$ of the first antenna 405 may need to be increased to compensate for the reduced angle $\alpha_2$ between the line of maximum intensity 412 and the lower line of reduced intensity 419 resulting from a more concentrated distribution of radiation, to maintain the position P1 at which the lower intensity line 419 intercepts the surface close to the support structure.

In some embodiments, the angle subtending the upper and lower lines of reduced intensity is about 45°, with the elevational angle $\gamma_1$ between the horizontal and upper reduced intensity line being about 15° and the angle $\gamma_2$ between the horizontal 411 and the lower reduced intensity line 419 being about −30°.

Figure 12:
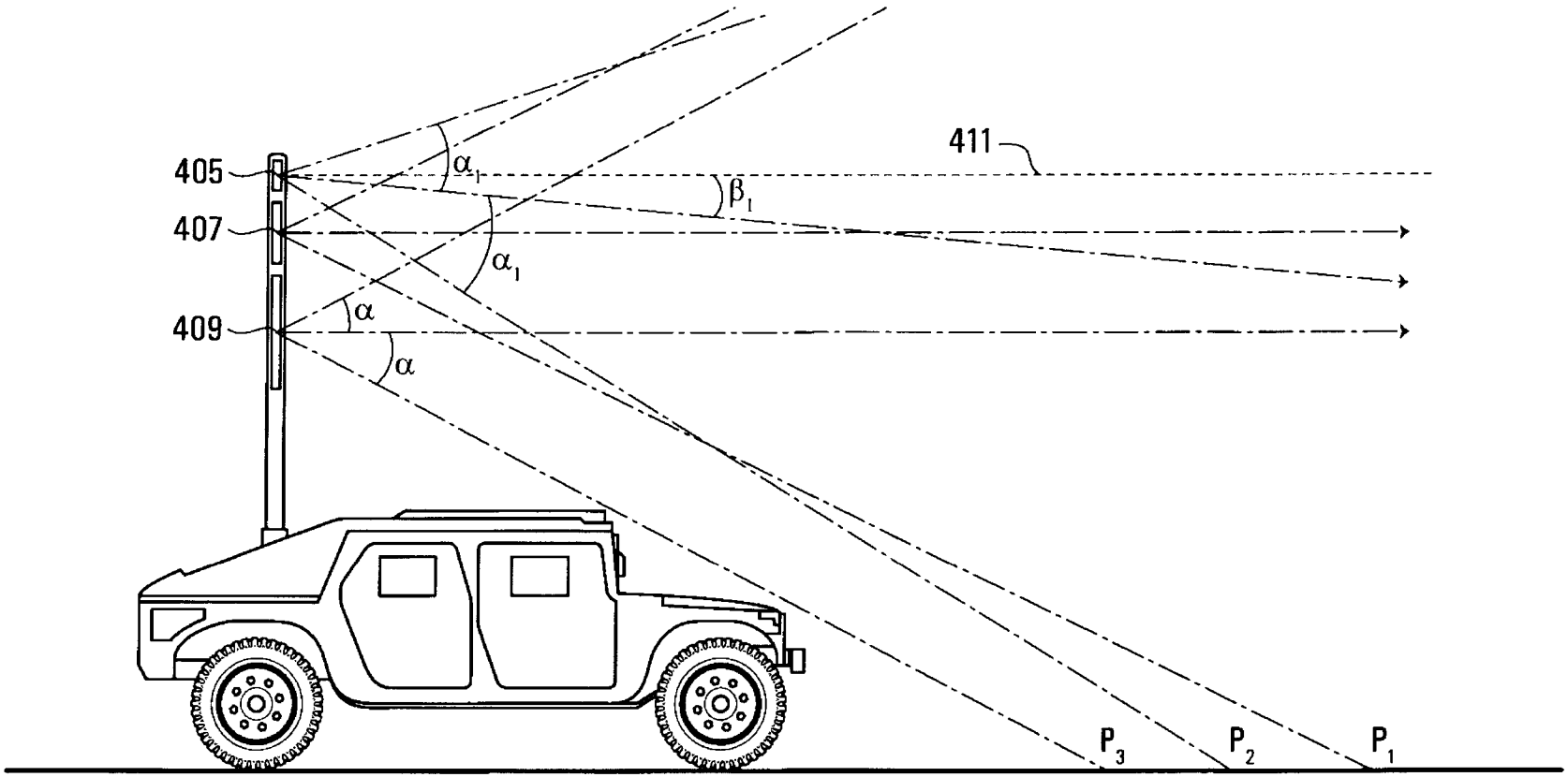
FIG. 12 shows a side view of an antenna assembly according to an embodiment of the present invention.

FIG. 12 illustrates another arrangement showing distributions of electromagnetic radiation from an antenna assembly having three antennas. In this arrangement, the radiation distribution from the first antenna 405 is tilted downwardly by an angle $\beta_1$ relative to the horizontal 411, the radiation distribution from the second antenna 407 is directed substantially horizontally but the elevational spread of radiation is more concentrated, and the radiation distribution from the third antenna 409 is both directed horizontally and has a standard elevational spread without concentration. The inventors have found that these radiation distributions from the antennas can be produced with the second antenna 407 radiating with electromagnetic radiation frequencies above those radiated by the third antenna 409 and below the RF frequencies radiated by the first antenna 405. In a particular embodiment, the inventors have found that relatively high frequency radiation from the first antenna 405 is affected by the radiation radiated by and/or the presence of both the second and third antennas 407, 409 to produce a downward tilt, that the radiation emitted by the second antenna 407 is affected by the radiation emitted by and/or the presence of the first and third antennas 405, 409 to produce a distribution with increased directivity and concentration and that the radiation distribution emitted by the third antenna 409 is substantially unaffected by the radiation emitted from and/or the presence of the first and second antennas.

In the arrangement of FIG. 12, the lower dipole element of the first antenna 405 couples to the second (and third) antenna 407 more than the upper dipole element of the first antenna, effectively extending the electrical length of the lower element relative to the upper element. This asymmetry tends to bias the emitted radiation downwardly.

The upper element of the second antenna 407 couples to the first antenna and the lower element couples to the third antenna 409. However, due to the longer length of the third antenna relative to the first, the lower element of the second antenna couples more strongly to the third antenna than the upper element does to the first antenna. In some embodiments, this may effectively increase the electrical length of the lower element relative to the upper element, thereby biasing the radiation from the second antenna downwardly.

In any of the embodiments described herein, the direction of radiation from an antenna can be controlled by controlling the relative phase of RF signals between the antenna and another adjacent antenna, for example in an arrangement where the antennas are positioned one above the other. The elevational distribution of electromagnetic radiation from an antenna may be controlled in a similar manner. Some embodiments may include a phase controller for controlling the relative phase of signals passed to two or more antennas. For example, one or more phase controllers may be included in the RF transmitter/receiver of the embodiment of FIG. 8. The phase controller(s) may be included with the switch/multiplexer module or separately, for instance. Alternatively, or in addition, the direction and/or distribution can be controlled by controlling the relative frequency (and/or amplitude) of radiation emitted by the antenna and that emitted by one or more adjacent antennas. Alternatively, or in addition, the antenna or an antenna array may be structured to provide the required direction of emitted radiation and elevational distribution. Examples of antenna structures capable of biasing the direction of radiation downwardly are described below with reference to FIGS. 16A to 16C.

Figure 13:
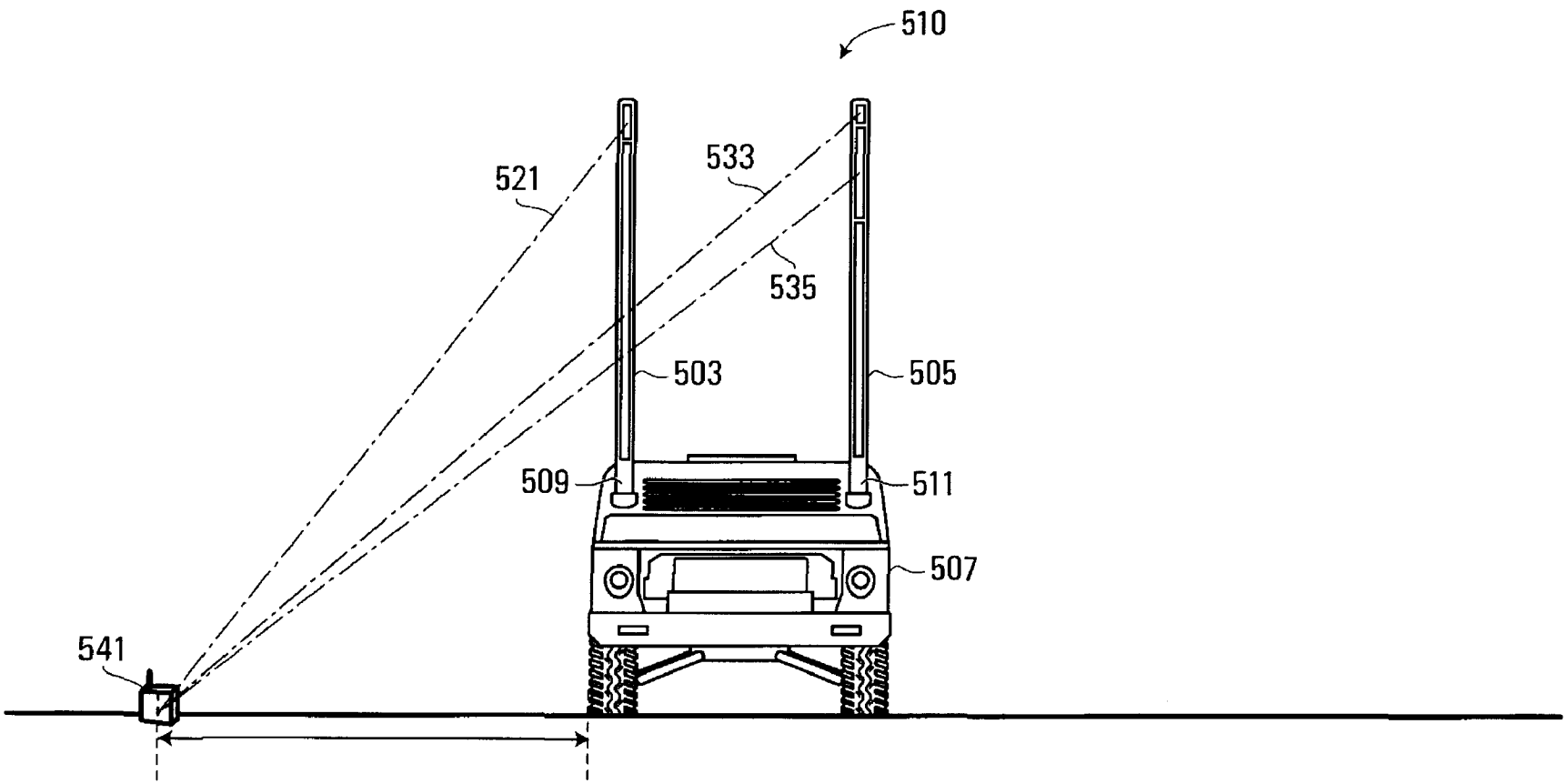
FIG. 13 shows a rear view of an antenna assembly according to an embodiment of the present invention.
Figure 14:
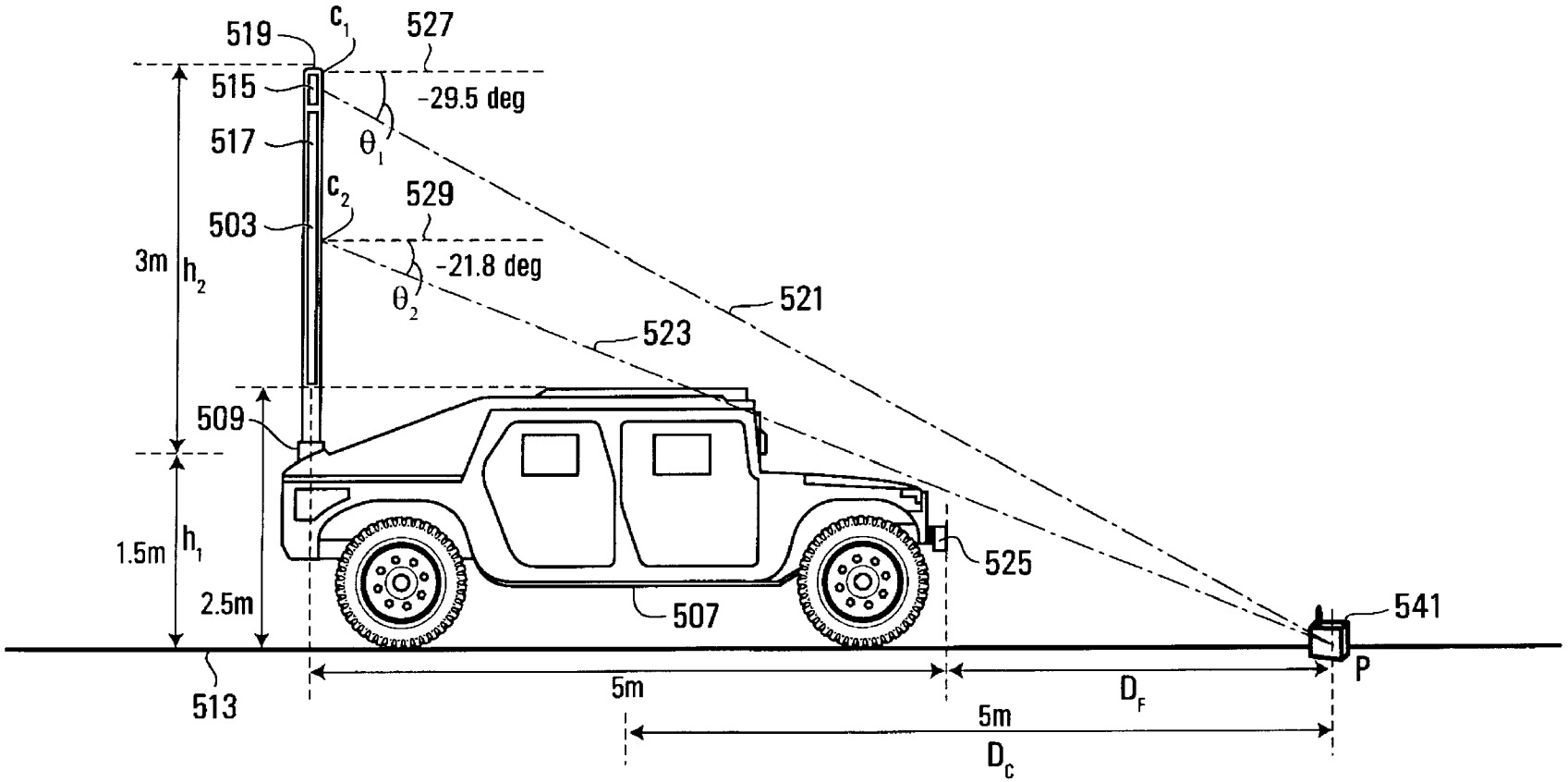
FIG. 14 shows a side view of an antenna assembly according to an embodiment of the present invention.
Figure 15:
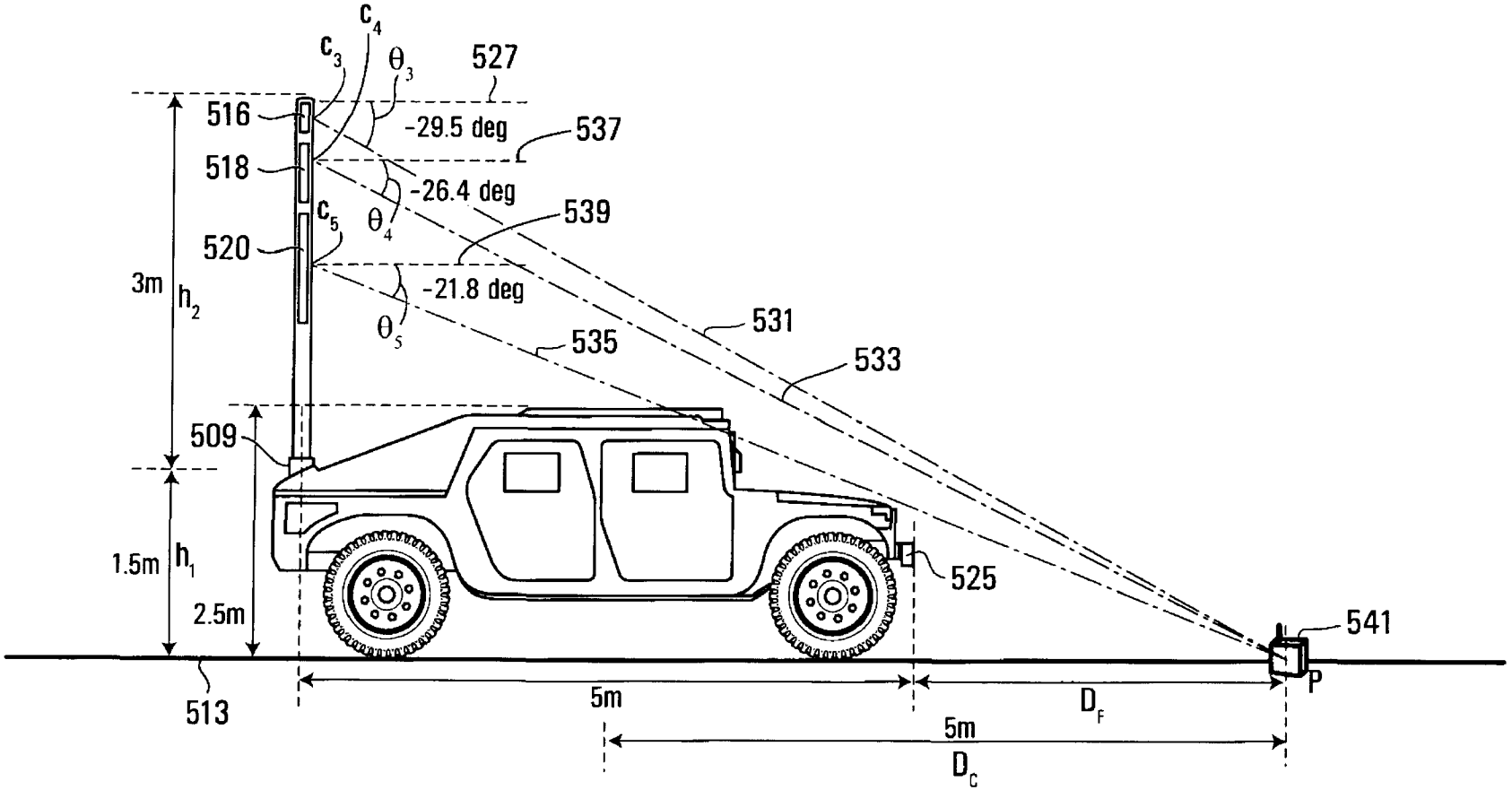
FIG. 15 shows a side view of an antenna assembly according to an embodiment of the present invention.

FIGS. 13 to 15 show an example of an antenna system mounted on a vehicle. The antenna system 501 comprises first and second antenna assemblies 503, 505 mounted on and upstanding from the rear portion of a vehicle 507. Each antenna assembly 503, 505 has a base 509, 511 which, when mounted on the vehicle, is positioned at a height $h_1$ above the surface 513. In a specific, non-limiting example, the height $h_1$ is 1.5 meters. FIG. 14 shows a side view of the first antenna assembly 503 which, in this embodiment, includes two antennas 515, 517, in which the first antenna 515 is positioned above the second antenna 517. The antenna assembly has a height $h_2$ from the base 509 to the top 519, and in a specific, non-limiting example, the height $h_2$ is 3 meters. FIG. 14 shows two lines 521, 523 from the center C1, C2 of the respective first and second antennas 515, 517 to a point P on the surface 513 positioned at a distance $D_C$ from the center of the vehicle 507 or a distance $D_F$ from the front peripheral edge 525 of the vehicle. In a specific, non-limiting example, the distance $D_C$ is 5 meters and the distance $D_F$ is 2.5 meters. The angle θ1 between the horizontal line 527 and the line 521 in this example is −29.50 and the angle θ2 between the horizontal line 529 and line 523 in this example is −21.80. Both angles are less than the elevation angle of 40° in which radiation emitted from a typical dipole antenna is reduced from a maximum by 3 dB. The line 521 constitutes a direct path from the first antenna 515 to point P on the surface, i.e. without obstruction by the vehicle. This arrangement allows the intensity of high frequency radiation that would normally be scattered by the vehicle, to be relatively high at point P, as described above. The first antenna assembly 503 may be the same or similar to that described above, with reference to FIGS. 4 and 6.

Referring to FIG. 15, the second antenna assembly comprises three antennas 516, 518, 520 positioned one above the other in a stacked configuration. FIG. 15 shows lines 531, 533, 535 between a respective center $C_3$, $C_4$, $C_5$ of each antenna to point P of the surface 513. The angle $\theta_3$ between the horizontal line 527 and line 531 in this example is −29.5°, the angle $\theta_4$ between the horizontal line 537 and line 533 in this example is −26.40 and the angle $\theta_5$ between the horizontal line 539 and line 535 in this example is −21.80. Each angle $\theta_3$, $\theta_4$ and $\theta_5$ is less than the elevational angle of 40° at which radiation emitted by a typical dipole antenna is reduced by 3 dB. Lines 531 and 533 between point P and the first and second antennas 516, 518 constitutes a direct path for electromagnetic radiation to the surface, without obstruction from the vehicle. This arrangement enables the intensity of relatively high frequency radiation that would normally be reflected by the vehicle, to be relatively high at point P. The second antenna assembly 505 may be the same or similar to the antenna assembly described above with reference to FIGS. 5 and 7. Any one or more antennas of the first and second antenna assemblies shown in FIGS. 13 to 15 may tilt the radiation distribution downwardly and/or provide a more concentrated distribution of electromagnetic radiation.

The combination of the first and second antenna assemblies 503, 505 of the antenna system 501 shown in FIGS. 13 to 15 enable relatively high frequency radiation emitted by the antenna system to have a relatively high intensity at positions close to the vehicle so that, for example, the intensity of high frequency signals received by a receiver 541 located at position P is relatively high.

Another aspect of the present invention provides an antenna which is capable of biasing the spread of emitted electromagnetic radiation either downwardly or upwardly, i.e. in a direction other than 90° relative to the antenna axis. Examples of embodiments of the antenna will now be described with reference to FIGS. 16A to 16C.

Figure 16A:
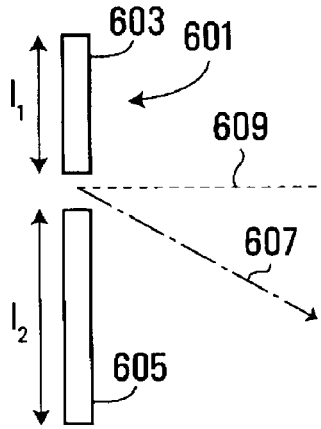
FIG. 16A shows a side view of a dipole antenna according to an embodiment of the present invention.

FIG. 16A shows an example of a dipole antenna 601 having upper and lower dipole elements 603, 605. In this embodiment, the length $L_2$ of the lower antenna 605 is greater than the length $L_1$ of the upper element 603, and this results in the spread of electromagnetic radiation being biased in a downward direction, as for example, shown by the direction of the broken line 607 relative to the horizontal line 609. In this embodiment, the width or diameter of the dipole elements is the same, although in other embodiments the widths or diameters of the dipole elements may be different from one another.

Figure 16B:
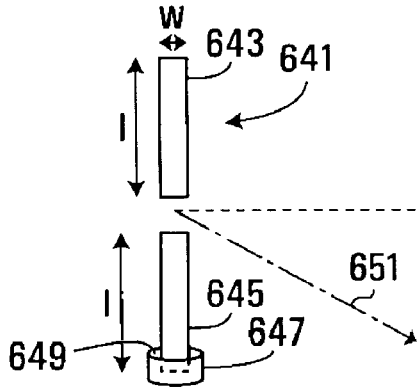
FIG. 16B shows a side view of a dipole antenna according to another embodiment of the present invention.

FIG. 16B shows another embodiment of a dipole antenna 641. The antenna comprises upper and lower dipole elements 643, 645 each of which has the same length, l, and optionally the same width, w. The antenna further comprises a coupling (or parasitic) element 647 which preferentially couples to the lower dipole element 645. In this embodiment, the coupling element 647 comprises a cylindrical ring which partially overlaps the length of the lower element 645 and is spaced therefrom by a gap 649. In other embodiments, the coupling element 647 may have any other form. The additional coupling element 647 has the effect of biasing the spread of electromagnetic radiation emitted from the antenna 641 in a downward direction as indicated by the broken line 651.

In the above antenna configurations shown in FIGS. 16A and 16B, the electrical length of the lower dipole element is longer than the electrical length of the upper element, thereby biasing the spread of electromagnetic radiation in a downward direction. Similar principles may be used to bias the spread of electromagnetic radiation in an upward direction, if desired.

In other embodiments, the features of the embodiments of FIGS. 16A and 16B responsible for biasing the direction of radiation up or down may be combined. For example, the antenna may have a lower dipole element that is longer than the upper element, and a parasitic element preferentially coupled to the lower element.

Figure 16C:
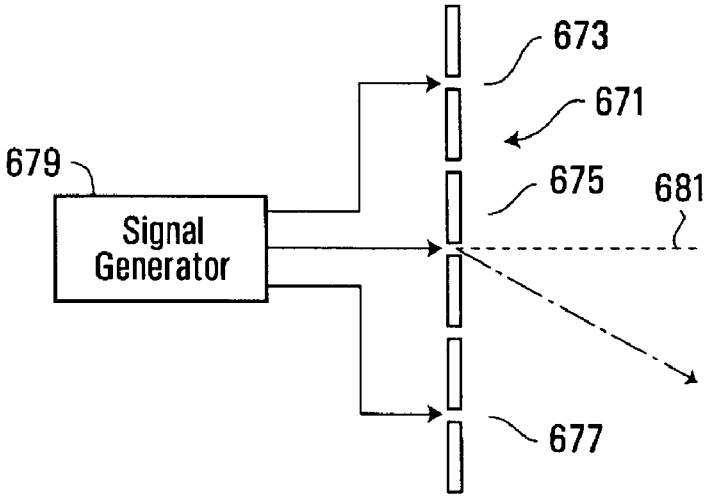
FIG. 16C shows an array of dipole antennas according to another embodiment of the present invention.

FIG. 16C shows another embodiment of an antenna array 671 comprising three stacked dipole antennas 673, 675, 677 each of which is connected to a signal generator 679. The signal generator 679 is adapted to generate a signal for each antenna in which the relative phase of the signals can be controlled to direct the spread of electromagnetic radiation in a desired direction, for example at an angle relative to the line 681 which is perpendicular to the dipole antenna axis. In this embodiment, each dipole antenna has the same length and each dipole element of each antenna also has the same length and the same width. In other embodiments, the length of one dipole antenna maybe different to at least one other dipole antenna to assist in biasing the emitted radiation in a desired direction. Alternatively, and/or in addition, one or more dimensions of a dipole element of an antenna may be different to that of the other dipole element of the same antenna to assist in biasing the spread of electromagnetic radiation in the desired direction. Alternatively, or in addition, one or more parasitic coupling elements may be included which couple to one or more elements of the same or different antennas in the array.

In any embodiment, one or more antennas may be vertically or cross-polarized. Cross-polarization has the benefit of mitigating spatial nulls caused by multi-path cancellation. Although fading will typically provide some gain for situations involving unmatched polarization, polarization diversity may enhance the performance irrespective of whether the vehicle or other support structure is stationary or moving.

In any embodiments, any antenna which is designed to operate at a frequency of greater than or equal to about 200 MHz or another frequency which is substantially reflected or scattered by the support structure may be arranged so that a direct path or line of sight exists between at least a portion of the antenna and one or more critical positions spaced a predetermined distance from either the center of or a peripheral edge of the support structure. In any embodiments, the antenna assembly may include a housing for accommodating the antennas and which is adapted to substantially prevent the ingress of moisture and/or particulate matter from the ambient.

Other aspects and embodiments of the present invention comprise any one or more features disclosed herein in combination with any one or more other features disclosed herein.

In any aspect or embodiment of the invention, any one or more features may be omitted altogether or substituted by another feature which may or may not be an equivalent or variant thereof.

Modifications to the embodiments described above will be apparent to those skilled in the art.

The invention claimed is:

1. An antenna for radiating electromagnetic radiation having opposed ends and a structure which biases the direction of radiation emitted outwardly from the antenna towards one of said ends and the antenna having coupling means for coupling the antenna to a signal generator for generating a jamming signal.

2. An antenna as claimed in claim 1, wherein the structure is asymmetric.

3. An antenna as claimed in claim 2, wherein the antenna comprises first and second radiating elements.

4. An antenna as claimed in claim 1, wherein the antenna comprises first and second radiating elements.

5. An antenna as claimed in claim 4, wherein said first element has a dimension that is different to a respective dimension of said second element.

6. An antenna as claimed in claim 5, wherein said dimension is length.

7. An antenna as claimed in claim 4, wherein said first element has a plurality of dimensions each of which is different to a respective dimension of said second element.

8. An antenna as claimed in claim 7, wherein said dimensions include length.

9. An antenna as claimed in claim 4, further comprising a coupling element arranged to couple preferentially with one of said first and second elements relative to the other of said first and second elements.

10. An antenna as claimed in claim 9, wherein said coupling element is adapted to capacitively couple with said one element.

11. An antenna as claimed in claim 10, wherein said coupling element comprises a second antenna.

12. An antenna as claimed in claim 10, further comprising a second coupling element arranged to couple to said other radiating element preferentially relative to said one radiating element.

13. An antenna as claimed in claim 12, wherein the coupling between said one radiating element and said first coupling element is stronger than the coupling between said other radiating element and said second coupling element.

14. An antenna as claimed in claim 12, wherein said second coupling element comprises a third antenna.

15. An antenna as claimed in claim 14, wherein said first coupling element is an antenna having a length different to that of said third antenna.

16. An antenna as claimed in claim 9, further comprising means for applying a signal to said antenna and to said coupling element, wherein the phase of the signal applied to said antenna is different to the phase of the signal applied to said coupling element.

17. An antenna as claimed in claim 1 including mounting means for mounting the antenna on a vehicle.

* * * * *